US007172415B2

(12) United States Patent
Harvey et al.

(10) Patent No.: US 7,172,415 B2
(45) Date of Patent: Feb. 6, 2007

(54) EQUINE DENTAL GRINDING APPARATUS

(75) Inventors: John B. Harvey, New London, WI (US); Travis J. Henry, Elkhorn, WI (US)

(73) Assignee: Flexi-Float, LLC, Spring Valley, WI (US)

( * ) Notice: Subject to any disclaimer, the term of this patent is extended or adjusted under 35 U.S.C. 154(b) by 0 days.

(21) Appl. No.: 10/719,572

(22) Filed: Nov. 22, 2003

(65) Prior Publication Data

US 2005/0112521 A1 May 26, 2005

(51) Int. Cl.
*A61D 5/00* (2006.01)

(52) U.S. Cl. ..... 433/1; 433/130; 606/84

(58) Field of Classification Search ..... 433/1, 433/165, 116, 125, 130, 134; 606/84, 85
See application file for complete search history.

(56) References Cited

U.S. PATENT DOCUMENTS

| | | | | | |
|---|---|---|---|---|---|
| 575,407 | A | * | 1/1897 | Wirsching | 433/1 |
| 670,086 | A | * | 3/1901 | Stanbrough | 433/1 |
| 741,519 | A | * | 10/1903 | Mahaffy | 433/1 |
| 854,955 | A | * | 5/1907 | Martin | 433/1 |
| 994,483 | A | * | 6/1911 | Sklar | 433/1 |
| 1,151,197 | A | * | 8/1915 | Lang | 433/1 |
| 2,442,033 | A | * | 5/1948 | Brantly et al. | 433/82 |
| 4,722,685 | A | * | 2/1988 | de Estrada | 433/1 |
| 5,851,111 | A | * | 12/1998 | Long et al. | 433/1 |
| 5,888,064 | A | | 3/1999 | Stubbs | |
| 6,273,712 | B1 | * | 8/2001 | Rach et al. | 433/1 |
| 6,610,066 | B2 | * | 8/2003 | Dinger et al. | 606/85 |

FOREIGN PATENT DOCUMENTS

| | | | |
|---|---|---|---|
| CH | 252232 | * | 10/1948 |
| DE | 30-02-386 A1 | | 7/1981 |
| EP | 1 369 093 A1 | * | 12/2003 |
| FR | 1.052.653 | | 1/1954 |
| FR | 1 052 653 | * | 1/1954 |
| FR | 2775585 | * | 9/1999 |
| GB | 838501 | * | 6/1960 |
| GB | 2 182 564 A | * | 5/1987 |
| JP | 9075379 | * | 3/1997 |

OTHER PUBLICATIONS

Makita Corporation, "Cordless Equine Rasp", Instruction Manual for Models 4399D and 4399DW, Jan. 22, 1993, Makita Corporation, Anjo, Alohl, Japan, 12 pages.

Milwaukee Electric Tool Corporation, "Heavy Duty Cordless Reversing Screwdriver with Adjustable Clutch", Care and Operating Instructions, Publication Date Unknown, Milwaukee Electric Tool Corporation, Brookfield, Wisconsin, USA, 3 pages.

* cited by examiner

*Primary Examiner*—Ralph A. Lewis
(74) *Attorney, Agent, or Firm*—Joseph W. Byrne

(57) ABSTRACT

An apparatus for grinding the teeth of horses is disclosed. The apparatus includes a tool body. A drive shaft is disposed inside of the tool body. A drive mechanism is connected to one end of the drive shaft. A grinding member is connected to the other end of the drive shaft. The grinding member can pivot through a range of angles relative to the drive shaft.

39 Claims, 17 Drawing Sheets

EQUINE DENTAL GRINDING APPARATUS

FIELD OF THE INVENTION

The present invention relates generally to a dental apparatus for use with animals. More specifically, it relates to an power equine dental apparatus for floating (grinding) the teeth of horses.

BACKGROUND OF THE INVENTION

Many animal species, in addition to humans, require dental work from time-to-time. One such species is the equine species (e.g., horses). A horse's teeth erupt continuously though out its lifetime. The continuous eruption of a horse's teeth cause the teeth to wear unevenly. Irregularities in the horse's teeth often develop as a result of this uneven wear. These irregularities can take the form of spikes or sharp projecting edges. These irregularities must be removed. If not removed, they can cause the horse to experience difficulty in chewing and/or can damage the soft tissues on the inside of the horse's mouth such as the cheeks and tongue.

Generally, veterinarians remove these irregularities through a procedure called "floating." In common terms, "floating" involves "filing," "grinding," or "rasping" the horse's teeth. Devices for floating a horses teeth are well known in the prior art. They range from hand-held manual floats and files to power floating devices having rotating or reciprocating grinding bits or pads.

Manual filing of a horses teeth can be a tiring and time consuming procedure. As a result, power floating devices have been developed to make floating a horse's teeth easier and more efficient. Such prior art power devices include the devices disclosed in U.S. Pat. No. 4,722,685 which issued on Feb. 2, 1988 to de Estrada; U.S. Pat. No. 5,851,111 which issued on Dec. 22, 1998 to Long et al.; U.S. Pat. No. 5,888,064 which issued on Mar. 30, 1999 to Stubbs; and U.S. Pat. No. 6,273,712 which issued on Aug. 14, 2001 to Rach et al.

Each of the prior art power floating devices disclosed above includes an elongated tool body or shaft. The elongated tool body is generally provided to allow the veterinarian to reach deep inside of the horse's mouth. At or near one end of the elongated tool body is the grinding bit or surface. At or near the other end is a handle or grip for holding the device.

The elongated tool body of each of these prior art devices is straight and rigid. Having the grinding bit disposed at the end of a long, straight, and rigid tool body can be problematic. This is because it limits the maneuverability of the power tool inside of the horse's mouth.

For example, it is common for tooth irregularities to be present in the very back of the horse's mouth. In many cases, it is difficult to get at these irregularities. This is because other structures inside of the horse's mouth, such as the horse's other teeth or cheeks, may be in the way. To properly float these teeth, therefore, the veterinarian must maneuver around these other structures. This often requires the veterinarian to approach these teeth at an angle.

Similarly, it is often desirable to actually place an angle on the surface of a horse's tooth. Thus, the veterinarian often approaches a particular tooth at an angle not because access is limited, but simply because an angled surface is the desired result.

Approaching teeth inside of a horse's mouth at an angle using the prior art devices disclosed above often requires the veterinarian to hold the straight, rigid, elongated tool body of these prior art devices at an angle. Holding these prior art devices at an awkward angle can be extremely tiring for the veterinarian.

In addition, it may not even be possible to achieve the required angle of attack using the prior art devices. This is because during the floating procedure, the horses mouth is held open. If the angle needed to reach or grind a particular tooth is too great, the various structures of the horses open mouth, such as the lips or other teeth, will come into contact with the elongated tool body of the prior art devices and prevent the veterinarian from achieving the angle necessary to reach or properly grind the tooth requiring attention. This is especially true for teeth that reside deep in the horse's mouth.

It is desirable, therefore, to have a power floating apparatus that allows the veterinarian to grind teeth at various angles relative to the longitudinal axis of the elongated tool body while maintaining the elongated tool body in a horizontal or substantially horizontal position. Likewise, it is desirable to have a power floating device that will permit the veterinarian to reach teeth deep in the horse's mouth at an angle while maintaining the elongated tool body in a horizontal or substantially horizontal position, thus possibly avoiding interference with other structures in the horse's mouth. Preferably, the power dental tool will have an adjustable grinding end such that the grinding bit or surface can be angled relative to the elongated tool body.

Another problem with floating a horse's teeth is the need to remove the enamel dust that results from the grinding process. This dust can make it very difficult for the veterinarian to see inside of the horse's mouth. It is desirable, therefore, to have a system for vacuuming up the enamel dust that is produced by floating a horse's teeth. Preferably, the vacuum system will be integrated into the dental power tool and will provide suction in and around the grinding bit or grinding surface.

Finally, because many of the teeth that require floating are deep inside of the horses mouth, visibility may be limited. It is desirable, therefore, to also have a source of light available to the veterinarian. Preferably, the source of light will be integrated into the dental power tool and will provide adequate light in the vicinity of the tooth to be ground.

SUMMARY OF THE PRESENT INVENTION

According to a first aspect of the invention, an equine dental apparatus for floating the teeth of horses includes a tool body, a drive shaft and a grinding member. The drive shaft is disposed inside of the tool body and includes a first end configured for attachment to a drive mechanism. The grinding member is connected to the second end and is partially housed in the tool body. The grinding member is capable of pivoting through a range of angles relative to the drive shaft in this embodiment.

Other principal features and advantages of the invention will become apparent to those skilled in the art upon review of the following drawings, the detailed description and the appended claims.

BRIEF DESCRIPTION OF THE DRAWINGS

The drawings, which constitute a part of the specification, are as follows.

Figure 1:
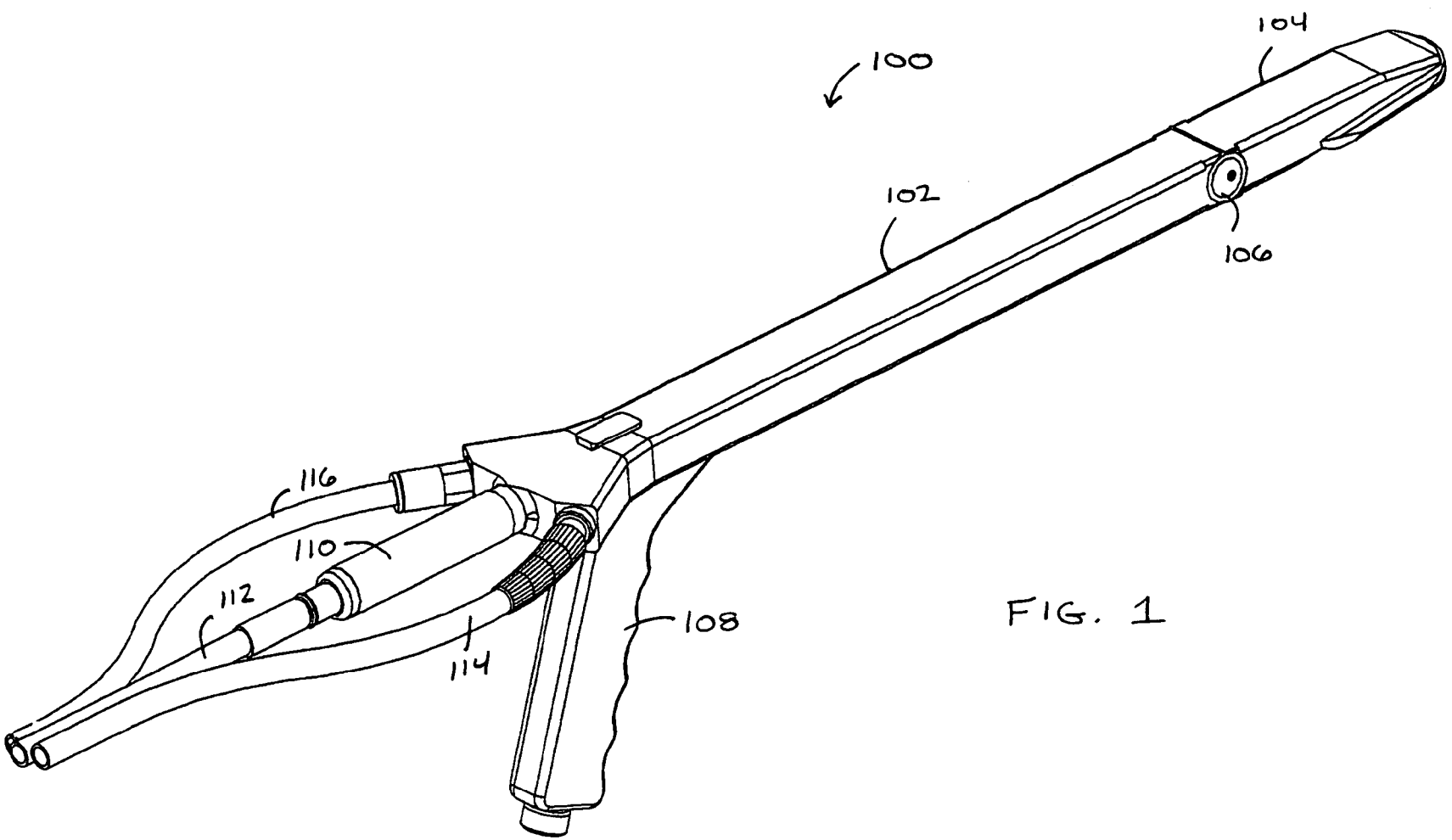
FIG. 1 is an isometric top-side view of a power equine dental tool according to one embodiment of the present invention.

Before explaining at least one embodiment of the present invention in detail it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting. Like reference numerals are used to indicate like components.

DETAILED DESCRIPTION OF THE PREFERRED EMBODIMENTS

While the present invention will be illustrated with reference to a particular apparatus having a particular configuration and particular features, the present invention is not limited to this configuration or to these features and other configurations and other features can be used. Also, although the present invention will be illustrated with reference to an equine dental apparatus, the present invention is not necessarily limited to usage with the equine species and may have application with other species as well.

Generally, the present invention involves an apparatus for floating (e.g., grinding, filing or rasping) the teeth of horses. The apparatus is elongated to reach deep into the horse's mouth. An adaptor for connecting the apparatus to a drive mechanism such as a variable speed motor is disposed at one end of the apparatus. A drive shaft is connected to the adaptor and runs through the center of the apparatus defining a longitudinal axis for the apparatus. A grinding bit or bur is disposed at or near the other end of the apparatus and is connected to the drive shaft at a pivot joint. The pivot joint allows the grinding bit to pivot at various angles to the longitudinal axis. Thus, the elongated body of the apparatus remains horizontal or substantially horizontal while at the same time, the grinding bit or bur is angled relative to the elongated tool body. The bit end of the dental tool can be adjusted through a range of angles in one embodiment to allow for the grinding of teeth in various locations.

A handle is attached near the drive end of the dental tool to allow the dental veterinarian to hold the apparatus. The handle is reversible in one embodiment of the present invention such that it can be attached to the top or bottom of the elongated tool to allow for grinding both the upper and lower teeth.

The apparatus also includes a vacuum system in one embodiment for vacuuming up enamel dust that is produced during the floating procedure. Vacuum ports run the entire length of the apparatus. A vacuum system is connected to the rear end of the apparatus opposite the grinding bit. The vacuum ports open up, one on either side of the grinding bit, to provide suction for vacuuming up the enamel dust that is produced during the floating procedure.

The apparatus includes a source of illumination in another embodiment. Light source cable ports run the entire length of the apparatus from the rear end of the apparatus to the bit end. Fiber optic cables are disposed inside of the light source cable ports. A source of light is connected to the internal light source cable at the rear end of the apparatus. The light source cable ports open up, one on either side of the grinding bit, to provide light from the light source to the tooth being floated.

An equine dental power tool 100 (also referred to herein as a dental floating tool) according to one embodiment of the present invention is shown in FIG. 1. Dental power tool 100 includes an tool body assembly 102, a bit housing assembly 104, a pivot joint 106, a pistol grip handle 108, and an angle locking handle 110. In addition, FIG. 1 also shows a flexible drive cable 112, an external light source cable 114, and a vacuum system hose 116 attached to dental power tool 100.

Bit housing assembly 104 is attached to the front end (also referred to as the pivot end or bit end) of tool body assembly 102 via pivot joint 106. This allows bit housing assembly 106 to pivot upwards and downwards relative to tool body assembly 102. Pistol grip handle 108 and angle locking handle 110 are disposed at or near the rear end (also referred to as the drive end or accessory mounting end) of dental tool 100. Pistol grip handle 108 is positioned at or near the balance point of dental tool 100 to increase the maneuverability and reduce fatigue on the operator of the tool. Angle locking handle 110 is attached to the drive end of dental tool 100 and provides a means for locking bit housing assembly 104 at a desired angle relative to tool body assembly 102.

Figure 14:
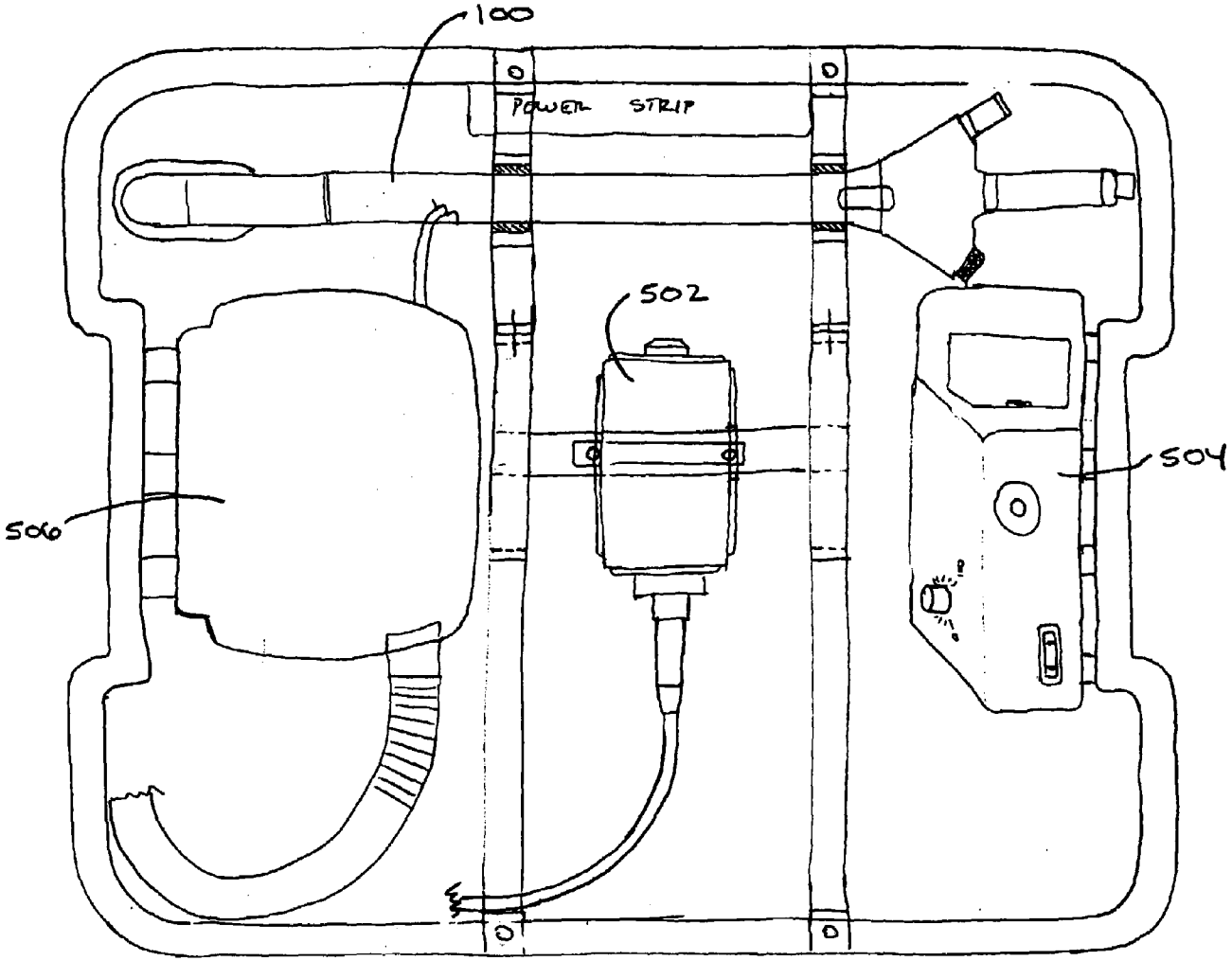
FIG. 14 is a top plan view of a modular equine dental grinding system according to another embodiment of the present invention.

Drive cable 112, external light source cable 114, and vacuum system hose 116 are also all attached to the drive end of dental tool 100. Drive cable 112 in this embodiment is a flexible drive cable that is connected between dental tool 100 and a drive system 502 such as a variable speed electric motor (see FIG. 14). One such drive system that can be used is the Series S flexible shaft power tool supplied by The Foredom Electric Company of Bethel, Conn.

External light source cable 114, which in the embodiment of FIG. 1 is a fiber optic cable, is connected between dental tool 100 and a light source 504 such as the Fiber-Lite® MI-150 Illuminator manufactured by Dolan-Jenner Industries of Lawrence, Mass. Vacuum hose 116 is connected between dental tool 100 and a vacuum system 506.

In should be understood that the present invention is not limited to the particular drive mechanism, light source or vacuum system disclosed herein and in other embodiments, other mechanisms, sources and systems are used. It should also be understood that although the invention shown in FIG. 1 includes a vacuum system and a light source, other embodiments of the present invention may include only one or the other of these accessories or may not include either of these accessories or may include other accessories as well.

Figure 2:
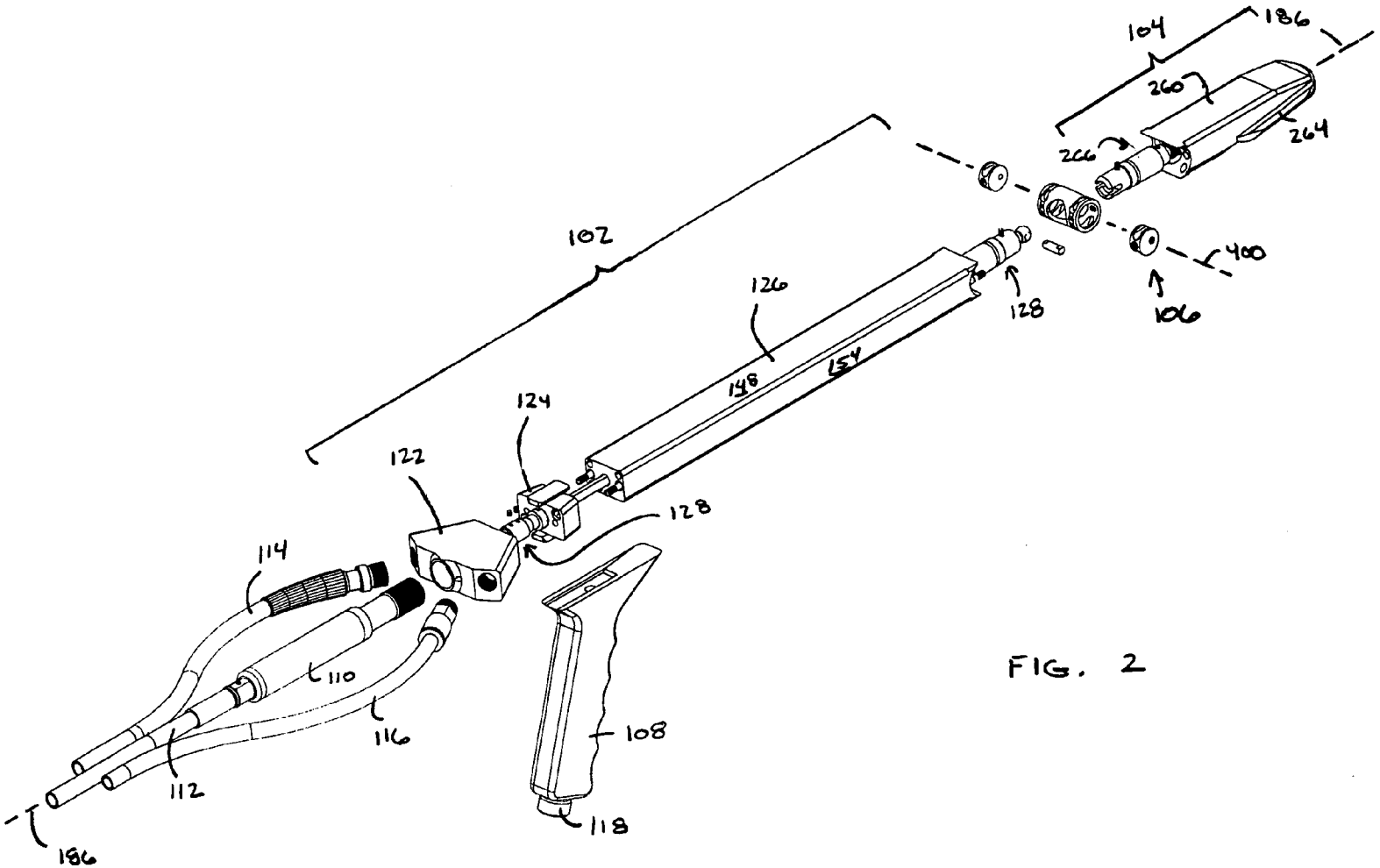
FIG. 2 is an exploded isometric top-side view of a power equine dental tool according to another embodiment of the present invention.
Figure 3:
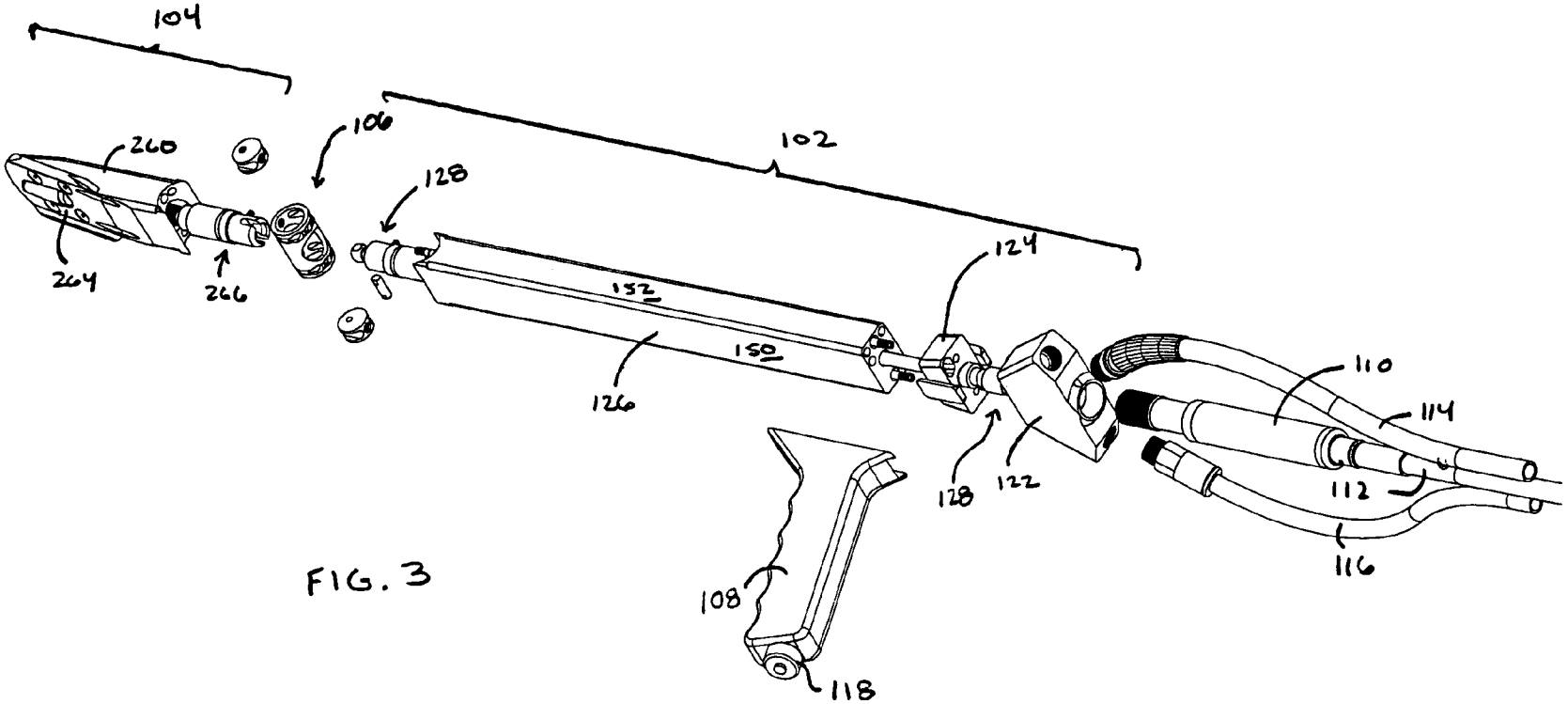
FIG. 3 is an exploded isometric bottom-side view of the power equine dental tool of FIG. 2.
Figure 6:
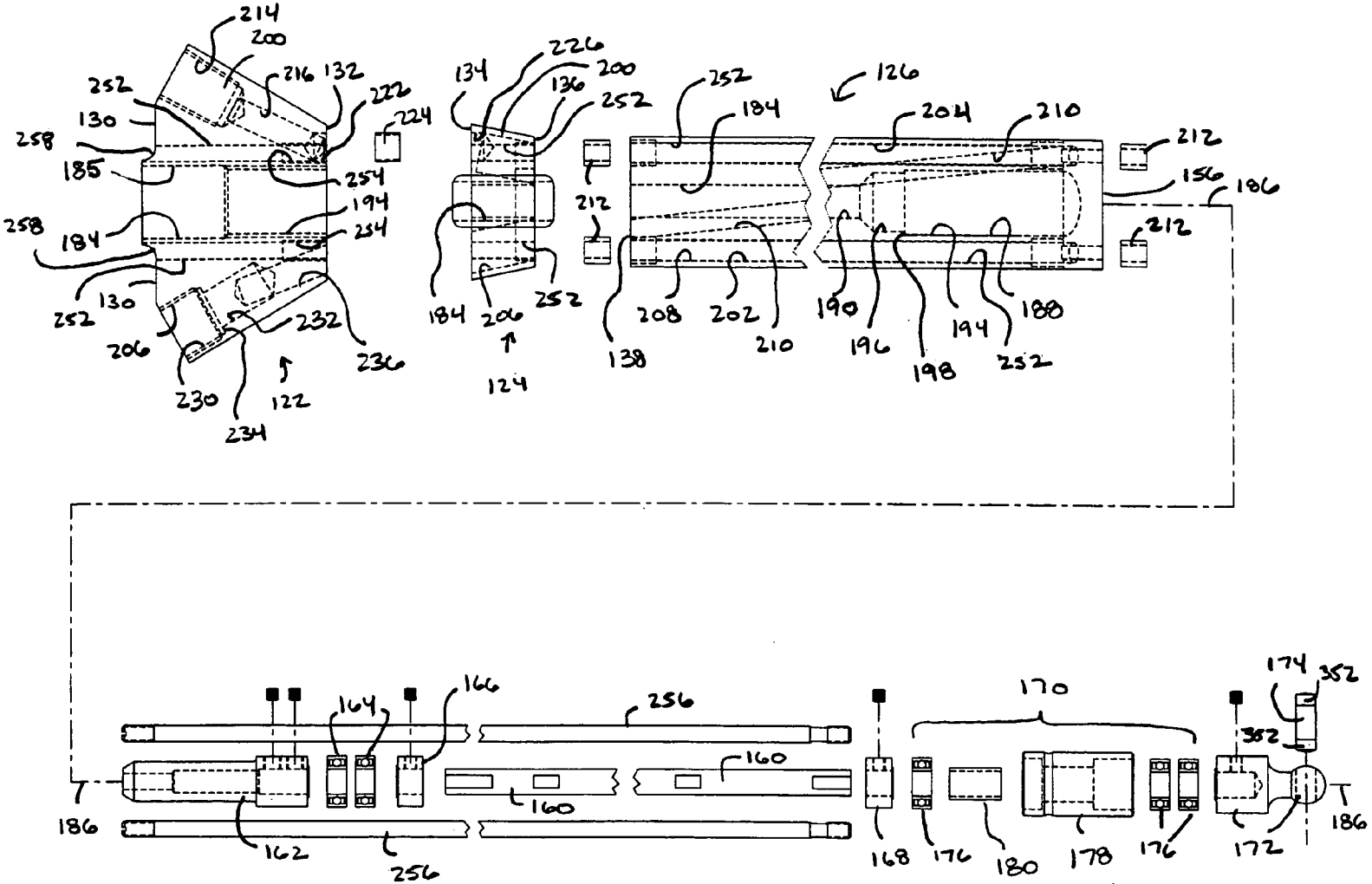
FIG. 6 is an exploded bottom plan view of the tool body assembly of the power equine dental tool of FIG. 2.

Tool body assembly 102, as best shown in FIGS. 2, 3 and 6, is comprised of an accessory mounting block 122, a handle mounting block 124 (also referred to herein as the vacuum manifold), a tool body 126, and a drive shaft assembly 128. Although tool body assembly 102 as shown in these figures includes several different component parts, the present invention is not limited to these particular components or to the particular configuration of these components. Other embodiments of the present invention may not have these same components or may have other components in addition to the components shown in these figures.

Figure 4:
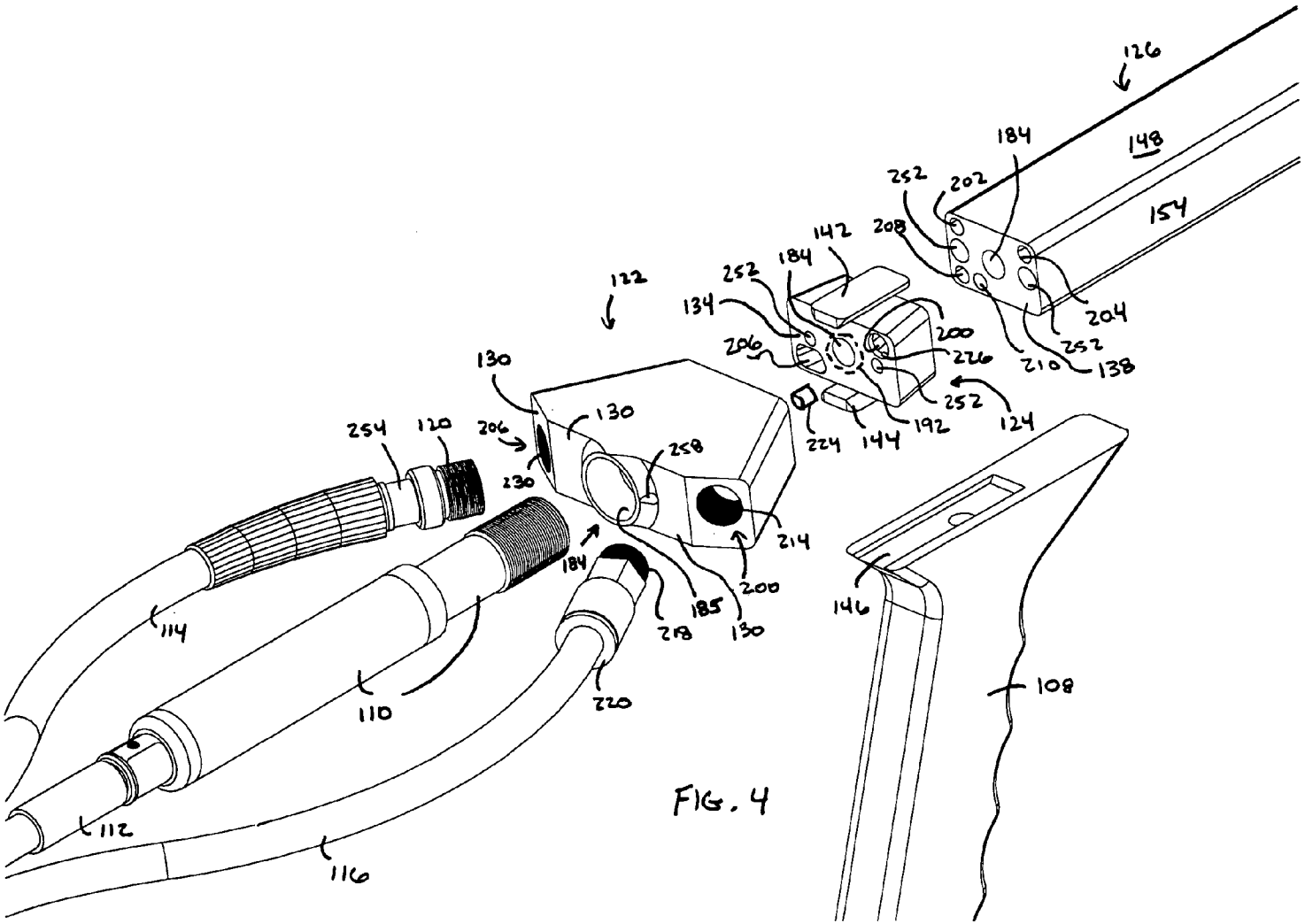
FIG. 4 is an exploded isometric close-up top-side view of the drive end of the power equine dental tool of FIG. 2 as viewed from the drive end of the power equine dental tool.
Figure 5:
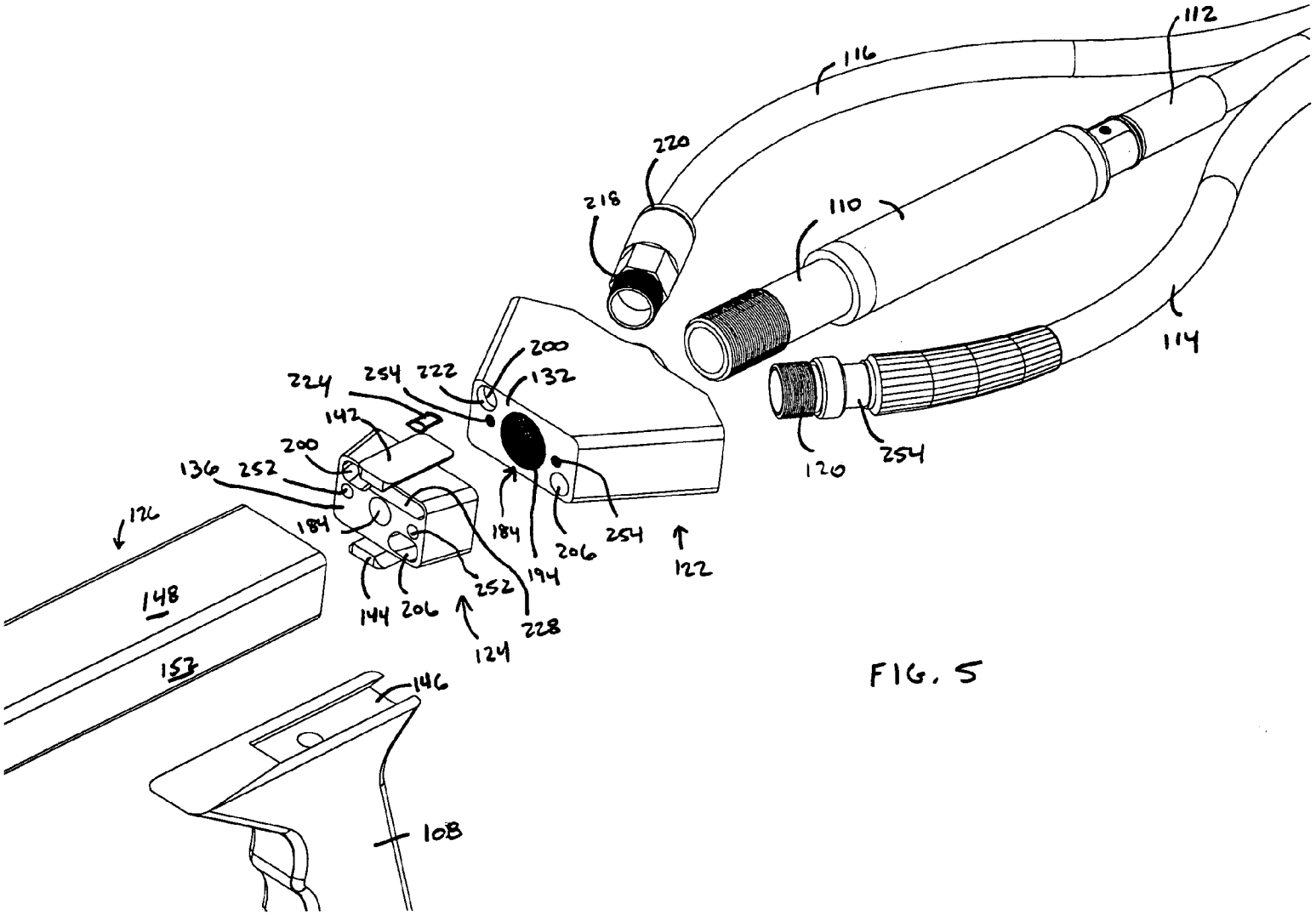
FIG. 5 is an exploded isometric close-up top-side view of the drive end of the power equine dental tool of FIG. 2 as viewed from the bit end of the power equine dental tool.

Accessory mounting block 122, which is disposed at the drive end of dental tool 100, includes a rear accessory mounting surface 130 and a front flat mating surface 132 (see FIGS. 4 and 5). Accessory mounting surface 130 is multi-faceted and configured for connection to the drive system and the various accessories (e.g., vacuum system, light source) that can be used with dental tool 100.

Handle mounting block 124 includes a rear flat mating surface 134 that mates flush against, and is complimentary to, front flat mating surface 132 of accessory mounting block 122 and a front flat mating surface 136 opposite rear flat mating surface 134. In addition, handle mounting block 124 also includes a pair of handle mounting flanges 142, 144. One of the handle mounting flanges is disposed on the top of handle mounting block 124 and the other handle mounting flange is disposed on the bottom of handle mounting block 124.

Flanges 142, 144 in this embodiment are dovetail flanges. In other embodiments, a T-bar is used as the mounting flange and a T-slot is included on pistol grip handle 108 as the mating surface.

Pistol grip handle 108 includes a complimentary groove 146 that mates with flanges 142 and 144. This allows pistol grip handle 108 to be mounted on the bottom side of dental tool 100 when dental tool 100 is used for floating a horse's lower teeth and on the top side of dental tool 100 when it is used to float the upper teeth in a horse's mouth. Pistol grip handle 108 can be locked in place on one of the mounting flanges by turning locking knob 118 (see FIGS. 2 and 3).

Tool body 126 (see FIGS. 4, 5 and 6) includes a top surface 148, a bottom surface 150, and a pair of opposing side surfaces 152, 154. The rear end or drive end of tool body 126 includes a flat mating surface 138 that is complimentary to, and mates flush against, front flat mating surface 136 of handle mounting block 124. The other end 156 of tool body 126, the pivot end (or the bit end), is a coped end having a concave curved end surface 140 (see FIG. 7). Curved surface 140 in the embodiment shown in the figures is semi-circular in shape and is provided to slidably engage with pivot joint 106 thereby allowing bit housing assembly 104 to pivot with respect to tool body assembly 102 as will be described more fully below.

Figure 11:
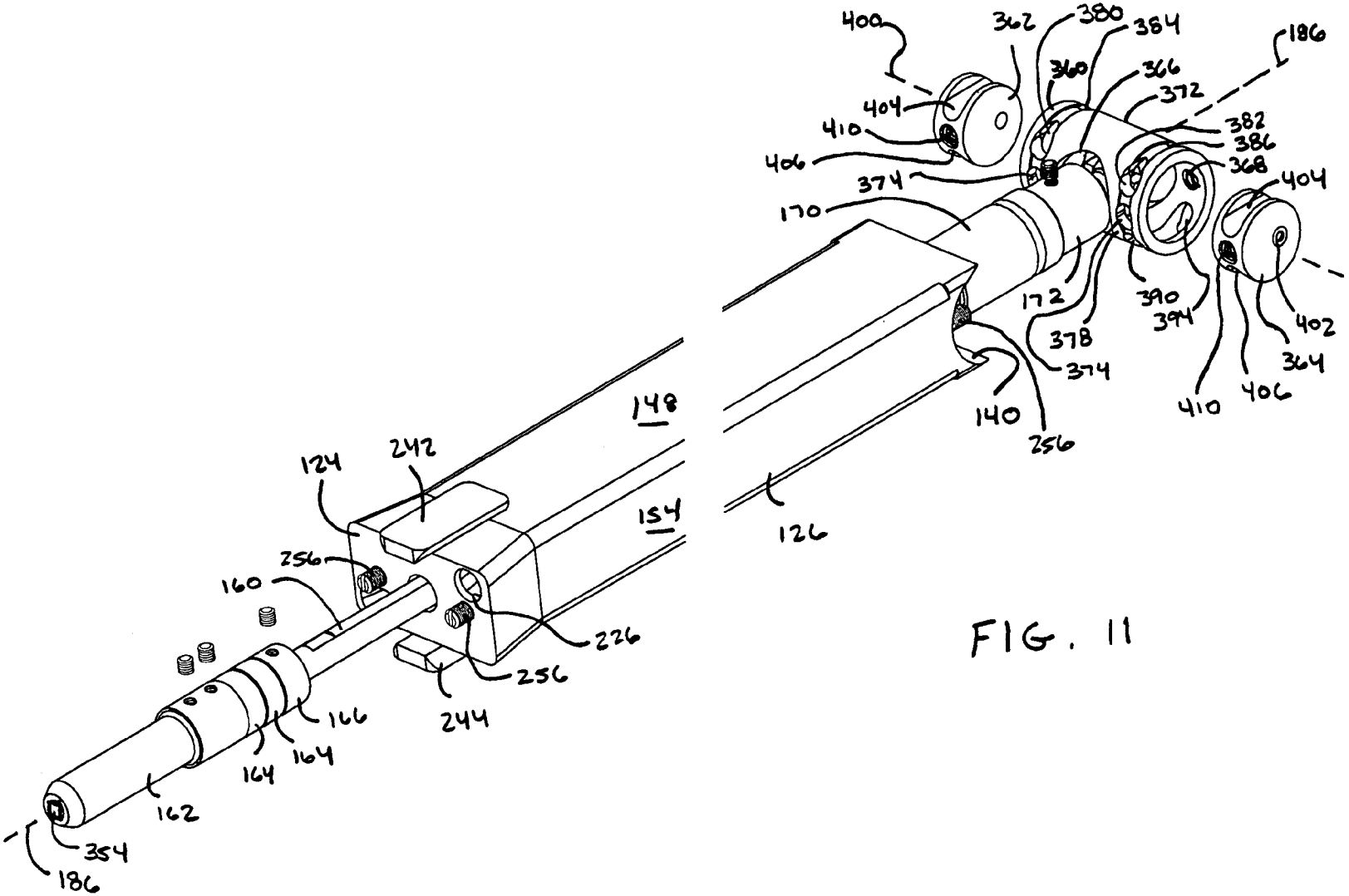
FIG. 11 is an exploded isometric close-up top-side view of the drive shaft assembly of the power equine dental tool of FIG. 2 as viewed from the drive end of the power equine dental tool.
Figure 12:
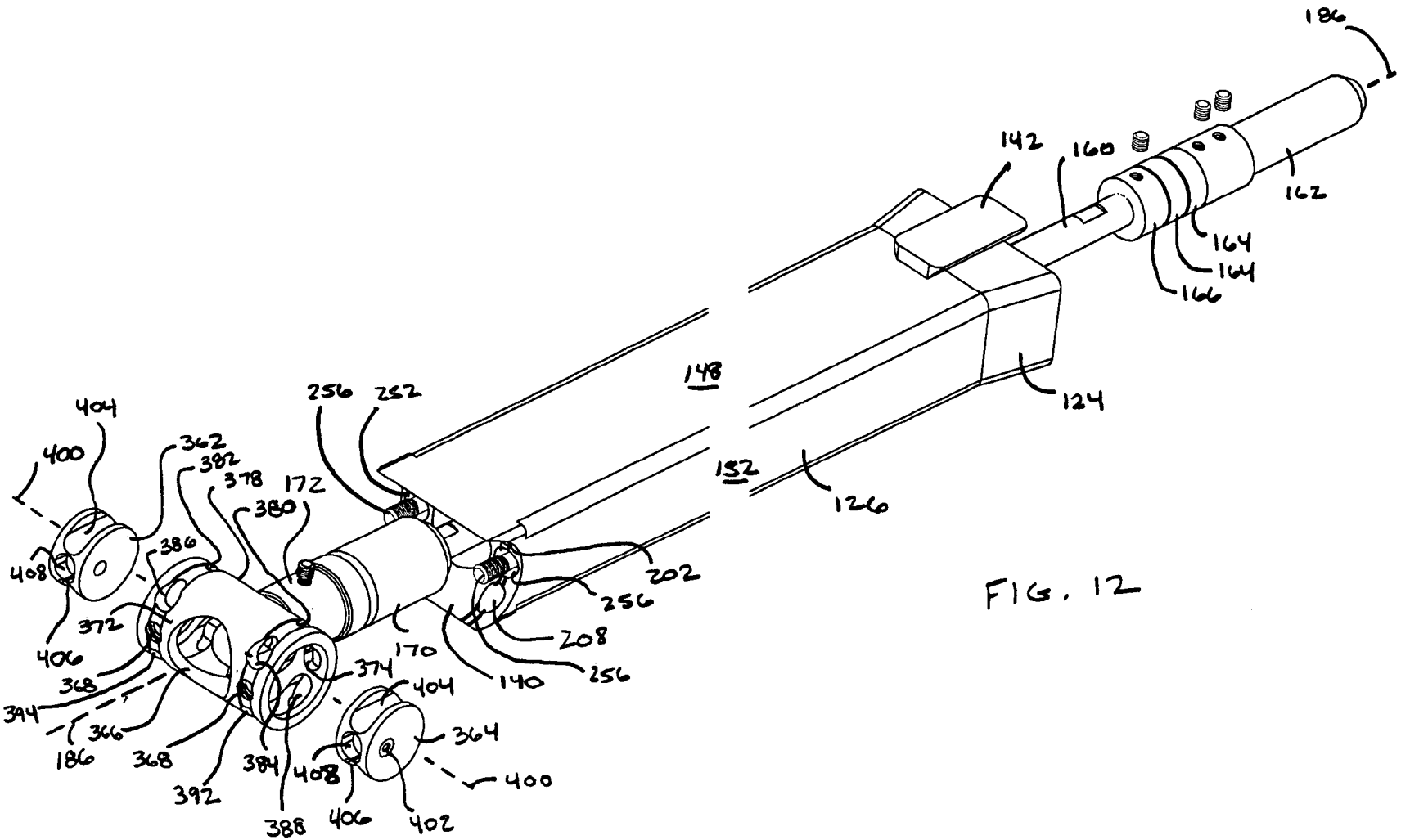
FIG. 12 is an exploded isometric close-up top-side view of the bit end of the power equine dental tool of FIG. 2 as viewed from the bit end of the power equine dental tool.

Drive shaft assembly 128 as best shown in FIGS. 6, 11 and 12 includes a drive shaft 160, a drive cable adaptor 162, a pair of sealed ball bearings 164, a first bearing retaining collar 166, a second bearing retaining collar 168, a bearing subassembly 170, and a drive ball 172. Drive cable adaptor 162 and bearings 164 are mounted on the rear end or drive end of drive shaft 160. Drive ball 172 and bearing subassembly 170 are mounted on the other end (e.g., the front end or pivot end) of drive shaft 160.

Drive cable adaptor 162 is mounted to the end of drive shaft 160 using a pair of set screws (in an alternative embodiment, a spring pin is used to secure drive cable adaptor 162 to the end of drive shaft 160). The end of drive cable adaptor 162 includes a square open receptacle 354 that is configured to mate with a complimentary mating adaptor (not shown) on the end of drive cable 112. Rotational motion is thereby transferred from the drive system to drive shaft 160 by way of the connection to drive cable adaptor 162.

Drive ball 172 is attached to the opposite end of drive shaft 160 (e.g., the pivot end) using either a set screw or a spring pin. Drive ball 172 includes a drive pin 174 that freely rotates inside of a hole drilled through the center of drive ball 172 at ninety (90) degrees to longitudinal axis 186. Drive ball 172 and drive pin 174 engage with a drive socket of bit housing assembly 104 to transmit rotational motion from drive shaft 160 to the grinding bit or bur as will be described below.

Bearings 164 and bearing subassembly 170 are disposed on drive shaft 160 to permit drive shaft 160 to rotate freely inside of tool body assembly 102. Sealed ball bearings 164 are disposed side-by-side on drive shaft 160 between drive cable adaptor 162 and bearing retaining collar 166. Bearing retaining collar 166 is secured to drive shaft 160 using a set screw or spring pin.

Bearing subassembly 170 is disposed in a similar manner near the other end of drive shaft 160 adjacent to drive ball 172. Bearing subassembly 170 includes three sealed ball bearings 176 disposed inside of a bearing housing 178. Two of the ball bearings are disposed side-by-side in bearing housing 178 and are separated from the third ball bearing by a bearing spacer 180. Bearing assembly 170 is held in place on drive shaft 160 by bearing retaining collar 168 on one side and by drive ball 172 on the other side. Bearing retaining collar 168 is also secured to drive shaft 160 using a set screw or spring pin.

Drive shaft assembly 128 is installed inside of a drive shaft opening 184 about a longitudinal axis 186 of dental tool 100. Drive shaft opening 184 runs the entire length of tool body assembly 102 through accessory mounting block 122, handle mounting block 124 and tool body 126. Drive shaft opening 184 is configured to house drive shaft assembly 128 and includes a drive end section 185 disposed inside of accessory mounting block 122, a bearing support section 188 located at the pivot end of tool body 126, and a smaller central section 190 disposed between the two end sections 185, 188. The central section 190 of drive shaft opening 184 passes through both handle mounting block 124 and a portion of tool body 126.

Drive end section 185 of drive shaft opening 184 includes a threaded inner section 194 (See FIG. 5). The front end of angle locking handle 110, which inserts into drive end section 185, is threaded and engages with threaded inner section 194. Drive cable adaptor 162 and bearings 164 are housed inside of angle locking handle 110 when drive shaft assembly 128 is installed inside of drive shaft opening 184.

The diameter of drive end section 185 passing through accessory mounting block 122 is greater than the diameter of central section 190 passing through handle mounting block 124. A locking shoulder 192 (see FIG. 4) is thereby formed around drive shaft opening 184 at the mating interface between accessory mounting block 122 and handle mounting block 124. It should be noted that bit housing assembly 104 can be locked in place at a desired angle by threading angle locking handle 110 completely into drive end section 185 until it abuts up against locking shoulder 192 on flat mating surface 134. The locking procedure will be described more fully below.

Bearing support section 188 of drive shaft opening 184 includes a first section 194 configured to receive bearing subassembly 170 and a second adjoining section 196 which is configured to accommodate bearing retaining collar 168. A shoulder 198 is formed between sections 194 and 196. Bearing subassembly 170 is lightly press fit into bearing support section 188 with its rearward end abutting up against shoulder 198 when drive shaft assembly 128 is installed inside of drive shaft opening 184.

In addition to drive shaft opening 184, tool body assembly 102 also includes a pair of vacuum ports 202, 204 and a pair of light source cable ports 208, 210. The vacuum ports are disposed to deliver vacuum suction to bit housing assembly 104. The light source cable ports are likewise disposed inside of tool body assembly 102 to deliver a source of illumination to bit housing assembly 104.

Each of the pair of ports mentioned above actually start out as a single port in accessory mounting block 122 and then divide into a pair of ports inside of tool body 126. For example, accessory mounting block 122 and handle mounting block 124 include a single vacuum port 200 that passes through from rear surface 130 of accessory mounting block 122 through to front mating surface 136 of handle mounting block 124. At the mating interface between handle mounting block 124 and tool body 126, vacuum port 200 interfaces with vacuum ports 202, 204 that run the entire length of tool body 126 to provide suction to bit housing assembly 104. Thus in this embodiment, handle mounting block 124 also acts as a vacuum manifold in that it feeds a pair of vacuum ports 202, 204 at its output from a single vacuum input port.

Vacuum port 200 includes a threaded hole 214 at its input that is drilled part way through accessory mounting block 122 from rear surface 130 and a second smaller diameter un-threaded hole 216 drilled part way through accessory mounting block 122 from front mating surface 132 (see FIG. 6). Threaded hole 214 and un-threaded hole 216 meet at an angle inside of accessory mounting block 122 to form a complete vacuum port passageway through accessory mounting block 122.

A vacuum hose adaptor (or connector) 218 is threaded into threaded input hole 214 and is configured to mate with a complimentary adaptor 220 on the end of vacuum hose 116 (shown attached to vacuum hose 116 in FIGS. 4 and 5). A small round recess 222 is reamed out on front mating surface 132 around un-threaded hole 216 to accommodate a small vacuum seal tube or sleeve 224. Vacuum seal tube 224 helps insure vacuum integrity when dental tool 100 is in use as will be described more fully below.

Vacuum port 200 enters handle mounting block 124 from accessory mounting block 122 through a small round hole 226 in rear mating surface 134. Hole 226 is also provided to receive vacuum seal tube 224 when handle mounting block 124 is mated with accessory mounting block 122. As vacuum port 200 passes through handle mounting block 122, it opens up into a larger slotted opening 228 that runs across the entire front mating surface 136 of handle mounting block 124 (see FIG. 5). Slotted opening 228 is configured to provide vacuum suction from a single port, namely vacuum port 200, to both vacuum ports 202, 204 of tool body 126. Thus, what starts out as a single vacuum port in accessory mounting block 122, divides into a pair of vacuum ports in tool body 126.

As mentioned above, vacuum port 200 is in vacuum communication with round vacuum ports 202, 204 of tool body 126. Vacuum ports 202, 204 run parallel with each other along the entire length of tool body 126 from rear mating surface 138 to curved pivot mating surface 140. Each vacuum port 202, 204 is disposed inside of tool body 126 adjacent to top surface 148 with one of the vacuum ports disposed adjacent to one side 152 of tool body 126 and the other vacuum port disposed adjacent to the opposite side 154 of tool body 126.

Like the vacuum ports that are disposed inside of tool body assembly 102, the light source cable ports also start out as a single port on the drive end or accessory mounting end of tool body assembly 102 and branch out into a pair of light source cable ports 208, 210 inside of tool body 126. More specifically, accessory mounting block 122 and handle mounting block 124 include a single light source cable port 206 that passes from rear surface 130 of accessory mounting block 122 through to front mating surface 136 of handle mounting block 124. At the mating interface between handle mounting block 124 and tool body 126, light source cable port 206 is in open communication with the pair of round light source cable ports 208, 210 that run the entire length of tool body 126.

The input portion of light source cable port 206, like vacuum port 200, is formed from two intersecting drilled holes, one of which is drilled from accessory mounting surface 130 and the other from front mating surface 132 of accessory mounting block 122. The input hole drilled from accessory mounting surface 130 is comprised of a first threaded outer section 230 that extends part way into accessory mounting block 122 and a smaller diameter un-threaded inner section 232 which is disposed adjacent to outer threaded section 230 (see FIG. 6). A shoulder 234 is formed between the inner and outer sections 230, 232 as a result of the differences in diameter of the two sections. Hole 236 is drilled from front mating surface 132 and intersects hole 232 at an angle inside of accessory mounting block 122 to provide a complete light source cable passageway through accessory mounting block 122.

Light source cable port 206 passes from accessory mounting block 122 directly through handle mounting block 124 from rear mating surface 134 to front mating surface 136. It should be noted that the portion of light source cable port 206 located in handle mounting block 124 is not round, but rather is an irregular shaped oblong opening configured to provide access to the pair of internal round light source cable ports 208, 210 of tool body 126.

Light source cable ports 208, 210 are each disposed inside of tool body 126 adjacent to bottom surface 150 and each port runs the entire length of tool body 126. Unlike vacuum ports 202, 204 however, light source cable ports 208, 210 are not parallel with each other. Rather, each of the two light source cable ports start out adjacent the same side 152 of tool body 126 and then diverge away from each other. Light source cable port 208, for example, is disposed inside of tool body 126 adjacent to side 152 over the entire length of tool body 126. Light source cable port 210 on the other hand, crosses over from side 152 to the opposite side 154 of tool body 126. In other words, although the two light source cable ports start out in the lower half of tool body 126 on the same side 152 of tool body 126 at rear mating surface 138, they diverge from each other such that at the coped pivot end 156 of tool body 126, each light source cable port opens up adjacent opposite sides of tool body 126.

Figure 13:
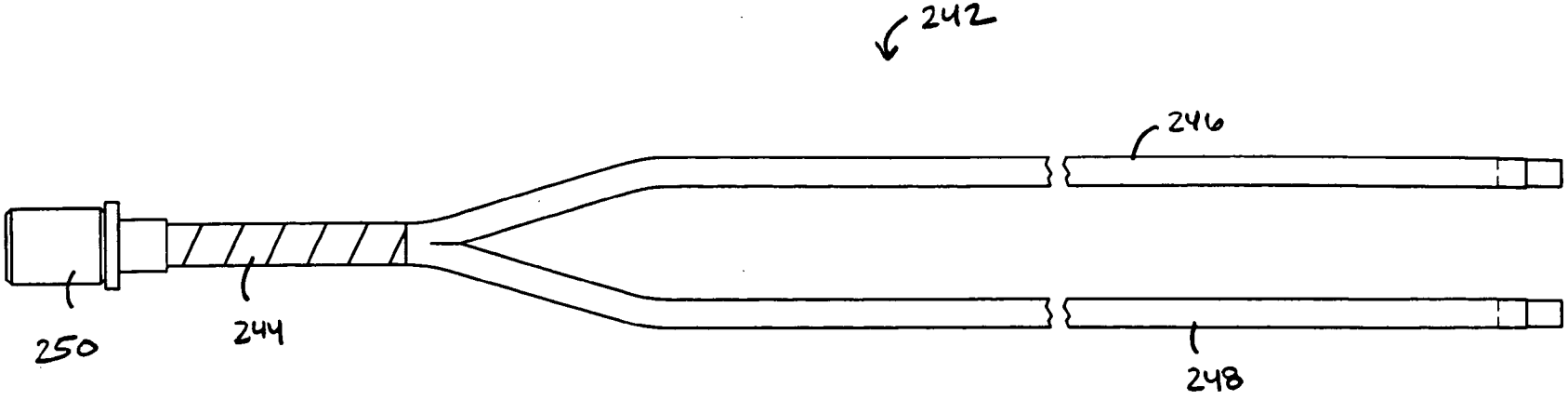
FIG. 13 is a plan view of an internal light source cable according to one embodiment of the present invention.

The various light source cable ports 206, 208, 210 of tool body assembly 102 are configured to receive an internal split-end light source cable 242 (see FIG. 13). Light source cable 242 is a fiber optic cable in this embodiment and includes a single non-split input cable 244 that splits into a pair of split output cables 246, 248. An adaptor or connector 250 is attached to the input end of light source cable 242.

It should be noted that the present invention is not limited to the use of fiber optics. In alternative embodiments of the present invention, other light source cables are used. For instance, in one other embodiment, a gel filled cable is used. In another embodiment, light bulbs or LEDs are provided at the bit end of the dental tool and copper wires are strung through the various light source cable ports to provide power to the bulbs or LEDs.

When installed into dental tool 100, non-split input cable 244 resides inside of light source cable port 206 while split cables 246, 248 are disposed inside of light source cable ports 208, 210. Adaptor 250 resides inside of threaded input hole 230 and abuts up against shoulder 234. A retaining collar 120 (shown attached to external light source cable 114 in FIGS. 4 and 5) threads into input hole 230 to hold adaptor 250 in place. Adaptor 250 is configured to mate with a light source cable adaptor 254 which is disposed on the end of external light source cable 114. Adaptor 254 simply plugs into adaptor 250 in this embodiment.

In addition to the various openings and ports thus far described, tool body assembly 102 also includes a pair of round holes 252 that run the entire length of tool body assembly 102. Each hole 252 runs parallel with longitudinal axis 186 on either side of drive shaft opening 184 and is configured to receive a draw rod 256. An oillube bushing 212 is press fit into the open ends of each draw rod hole 252 in tool body 126 to support the draw rods.

Each draw rod 256 is threaded on its ends. The ends of each draw rod 256 are threaded in opposite directions however. Thus, for example, the rear or drive end of each draw rod 256 includes a right-hand thread and the other end (the pivot end) of each draw rod includes a left-hand thread. In addition, the drive end of each draw rod is slotted at its end to receive the end of a slotted screwdriver (in alternative embodiments, other end configurations are used including a hex socket, a cross point socket, a torx socket, etc . . . ).

As previously mentioned, each draw rod hole 252 extends the entire length of tool body assembly 102 including through accessory mounting block 122. Draw rods 256, however, only extend a short distance into accessory mounting block 122 from front flat mating surface 132. Each draw rod hole 252 thus includes a threaded section 254 (see FIG. 5) in the vicinity of front flat mating surface 132 to engage with the threaded drive end of a draw rod 256. Screwdriver access to the slot on the drive end of each draw rod 256 is provided from accessory mounting surface 130 through the open end 258 of each draw rod hole 252.

Bit housing assembly 104 will now be described in detail. Bit housing assembly 104 as shown in FIGS. 7,8, 9 and 10 includes a bit housing 260, a grinding member 262, a bit guard 264, and a bit drive shaft assembly 266. Grinding member 262 is a steel shanked carbide bit in this embodiment. Bit 262 is partially disposed inside of bit housing 260. Bit guard 264 is attached to the underside of bit housing 260 and is disposed around grinding bit 262. The bit end (front end) of bit drive shaft assembly 266 is attached to grinding bit 262. The other end (e.g., the pivot end) of bit drive shaft assembly 266 is configured to interface with the pivot end of drive shaft 160.

Bit housing 260 includes a tapered front end 268 and a coped pivot joint end 270. The front end 268 of bit housing 260 is tapered to allow for easier maneuverability of dental tool 100 in the horse's mouth. The front end 268 of bit housing 260 is rounded and all of the exposed outer edges of bit housing 260 are radiused. This is done to reduce the possibility of damage to the horse's soft mouth tissues during the floating procedure.

The coped pivot end 270 of bit housing 260 includes a concave curved surface 274 which allows bit housing assembly 104 to mate with pivot joint 106. A pair of longitudinally oriented mounting holes 276 are disposed on either side of bit housing 260. These mounting holes are disposed to receive a pair of mounting screws 278 that attach bit housing 260 to pivot joint 106.

Figure 10:
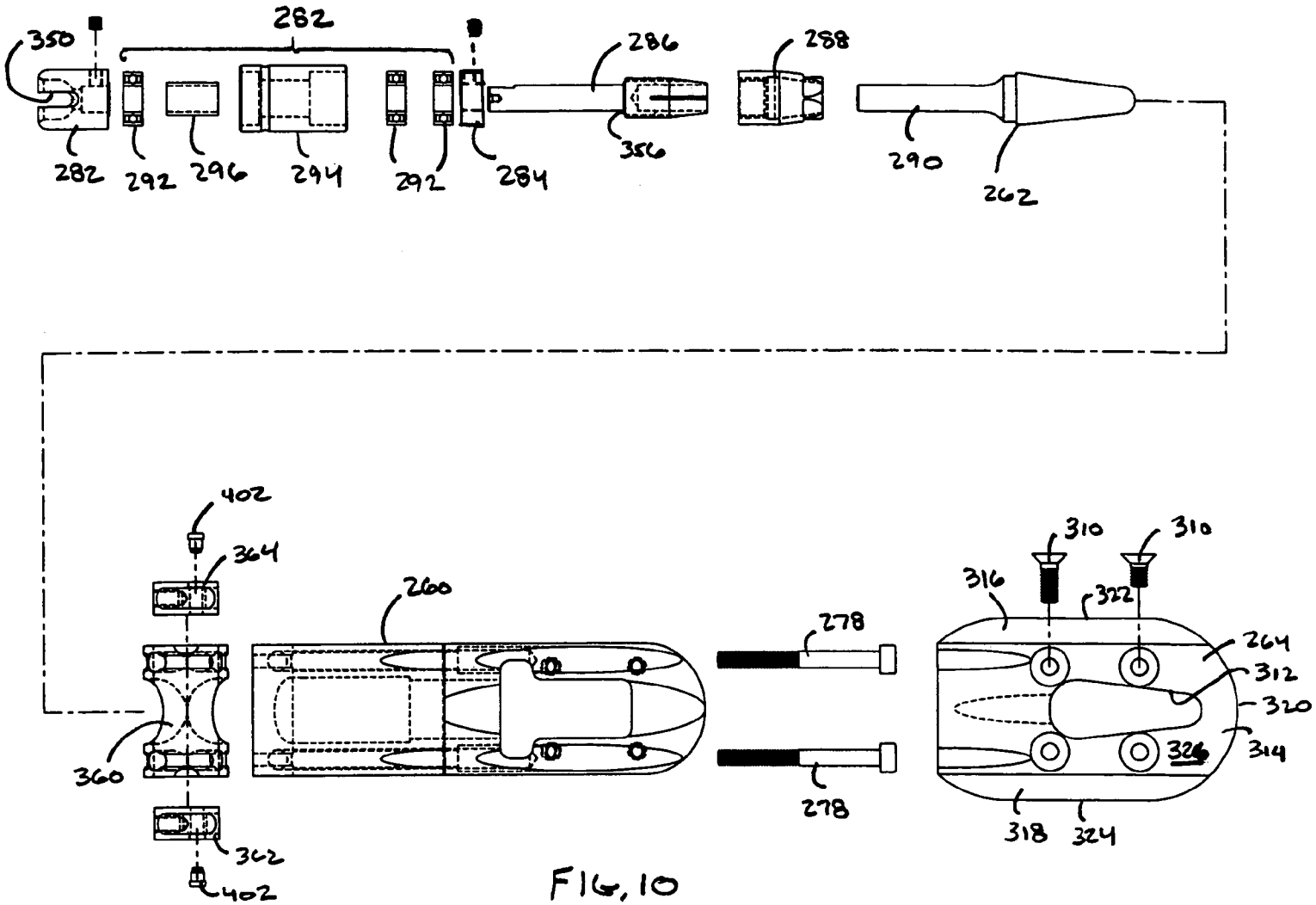
FIG. 10 is an exploded bottom plan view of the bit housing assembly and pivot joint of the power equine dental tool of FIG. 2.

Bit drive shaft subassembly 266 as shown in FIG. 10 includes a drive socket 280, a bearing subassembly 282, a collet shaft 286, and a collet nut 288. Bit 262 includes a bit shaft 290 that inserts into collet shaft 286 and is secured to collet shaft 286 using collet nut 288. Drive socket 280 is attached to the other end of collet shaft 286 using a small set screw or spring pin that engages with collet shaft 286.

Bearing subassembly 282 is disposed on collet shaft 286 adjacent to drive socket 280. Bearing subassembly 282 includes three sealed ball bearings 292 disposed inside of a bearing housing 294. Two of the ball bearings are disposed side-by-side in bearing housing 294 and are separated from the third ball bearing by a bearing spacer 296. In one embodiment, bearing assembly 282 is held in place on collet shaft 286 by shoulder 356 of collet shaft 286 on one side and by drive socket 280 on the other side. In an alternative embodiment, a bearing retaining collar 284 is used to secure bearing assembly 282 in place next to drive socket 280.

Figure 15A:
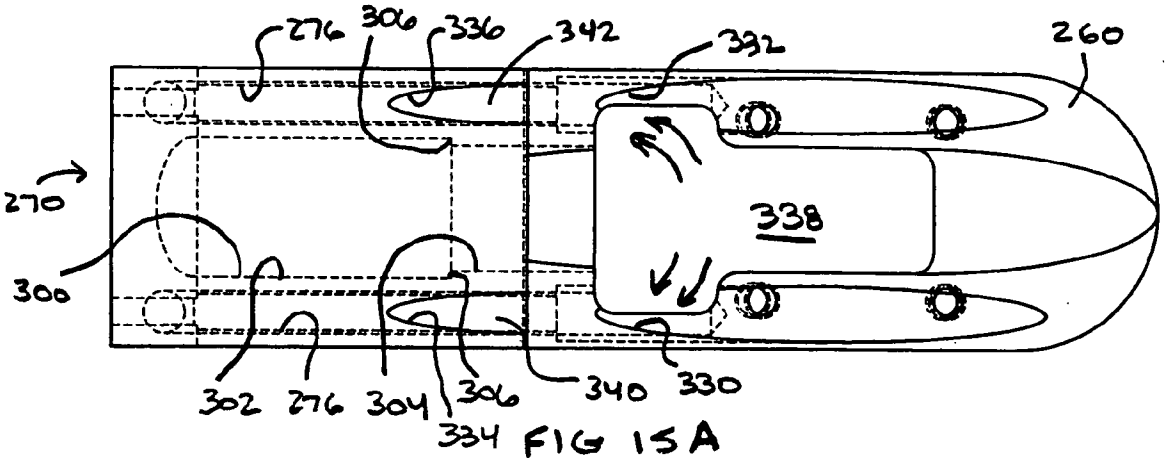
FIG. 15A is a bottom plan view of a bit housing according to one embodiment of the present invention.
Figure 15B:
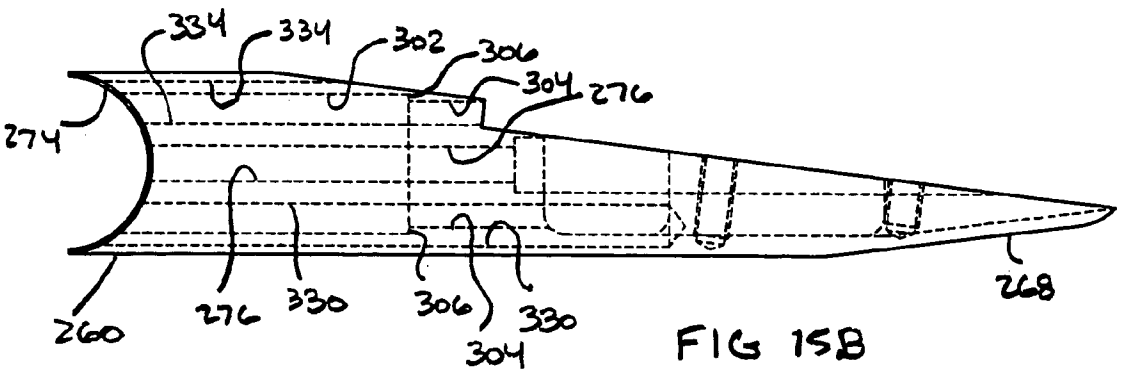
FIG. 15B is a side plan view of the bit housing of FIG. 15A.
Figure 15C:
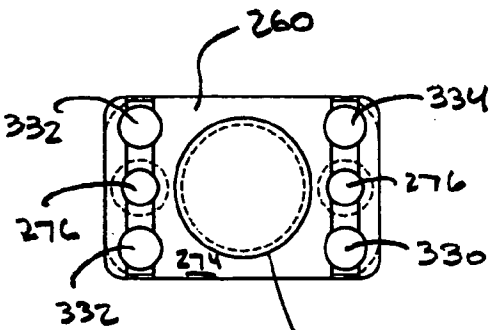
FIG. 15C is a rear end plan view of the bit housing of FIG. 15A.

Bit drive shaft subassembly 266 is housed in a bit drive shaft opening 300 (see FIGS. 15A–C) disposed inside of bit housing 260. Bit drive shaft opening 300 is comprised of a larger diameter bearing support section 302 and an adjoining smaller diameter section 304. A shoulder 306 is formed between the two sections 302, 304 and provides a stop for bit drive shaft subassembly 266 when it is fully inserted into bit drive shaft opening 300.

More specifically, when bit drive shaft subassembly 266 is properly installed inside of bit drive shaft opening 300, bearing subassembly 282 is lightly press fit into bearing support section 302 with its forward end abutting up against shoulder 306. In this position, bit 262, which is attached to the end of bit drive shaft subassembly 266, extends outward from the front end of bit drive shaft opening 300 and drive socket 280 extends outward from the pivot end of bit drive shaft opening 300.

Bit guard 264 is attached to the under side of bit housing 260 using four small mounting screws 310. Bit 262 protrudes through a central opening 312 in bit guard 264. Thus, bit housing 260 provides a complete cover or shield on the top side of bit 262 as bit 262 rotates while bit guard 264 provides a partial shield around bit 262 on the under side of bit housing 260 as bit 262 rotates.

Bit guard 264, like bit housing 260, includes many features that are designed to prevent damage to the soft tissues of the horse's mouth. For example, the front end 314 of bit guard 264 is curved and, along with sides 316, 318 of bit guard 264, extends outward from bit housing 260. In addition, the outer exposed edges 320, 322, 324 formed on front end 314 and sides 316, 318 respectively of bit guard 264 are radiused to eliminate the sharp edges that might otherwise be present around the outer perimeter of bit guard 264.

In addition to the safety features described above, sides 316, 318 of bit guard 264 are actually thicker than is the interior portion 326 of bit guard 264. The thicker sides allow for a larger radius to be placed on edges 322, 324 which in turn makes these edges even duller than they otherwise would be if the thickness of sides 316, 318 was reduced. This in turn further reduces the likelihood of damage to the horse's mouth during the floating procedure.

It should be noted that the present invention does not necessarily require any or all of the safety features described herein. Other embodiments of the present invention, for example, may include only some of these features or may not include any of these features. Likewise, other embodiments of the present invention may include other safety features not described herein.

Bit housing 260 (see FIGS. 15A–C), like tool body 126, includes a pair of vacuum ports 330, 332 and a pair of light source cable ports 334, 336. These various ports all run longitudinally through bit housing 260 and are disposed in-line with the corresponding vacuum and light source cable ports that exit coped pivot end 156 of tool body assembly 102 when equine dental tool 100 is completely assembled. For example, vacuum suction actually passes from vacuum ports 202, 204, through pivot joint 106, and into vacuum ports 330, 332 respectively to provide vacuum suction to bit housing assembly 104. In a similar manner, split light source cables 246, 248 pass from light source cable ports 208, 210, through pivot joint 106, and into light source cable ports 334, 336 to provide a source of light to the bit end of dental tool 100.

Looking at bit housing 260, it can be seen that vacuum ports 330, 332 open into a small vacuum chamber 338 that is formed around grinding bit 262 by bit housing 260 and bit guard 264. Vacuum suction is provided in and around the vicinity of grinding bit 262 (in the direction of the arrows shown in FIG. 15A) to suction up any enamel dust that is produced during the floating procedure.

The open ends 340, 342 of each light source cable port 334, 336 terminate at a point rearward of grinding bit 262 on either side of grinding bit 262. Unlike vacuum ports 330, 332, however, the open ends of light source cable ports 334, 336 are disposed on the outside of bit guard 264, not on the inside. Each split light source cable 246, 248 terminates near the open end 340, 342 of its respective light source cable port 334, 336. Thus, light from the ends of light source cables 246, 248 is provided from the open ends 340, 342 of light source cable ports 334, 336 and shines on grinding bit 262 and on to the tooth being floated. Bit guard 264 is preferably made from a light colored material, such as a white plastic material, to further reflect the light onto the tooth being floated.

Figure 7:
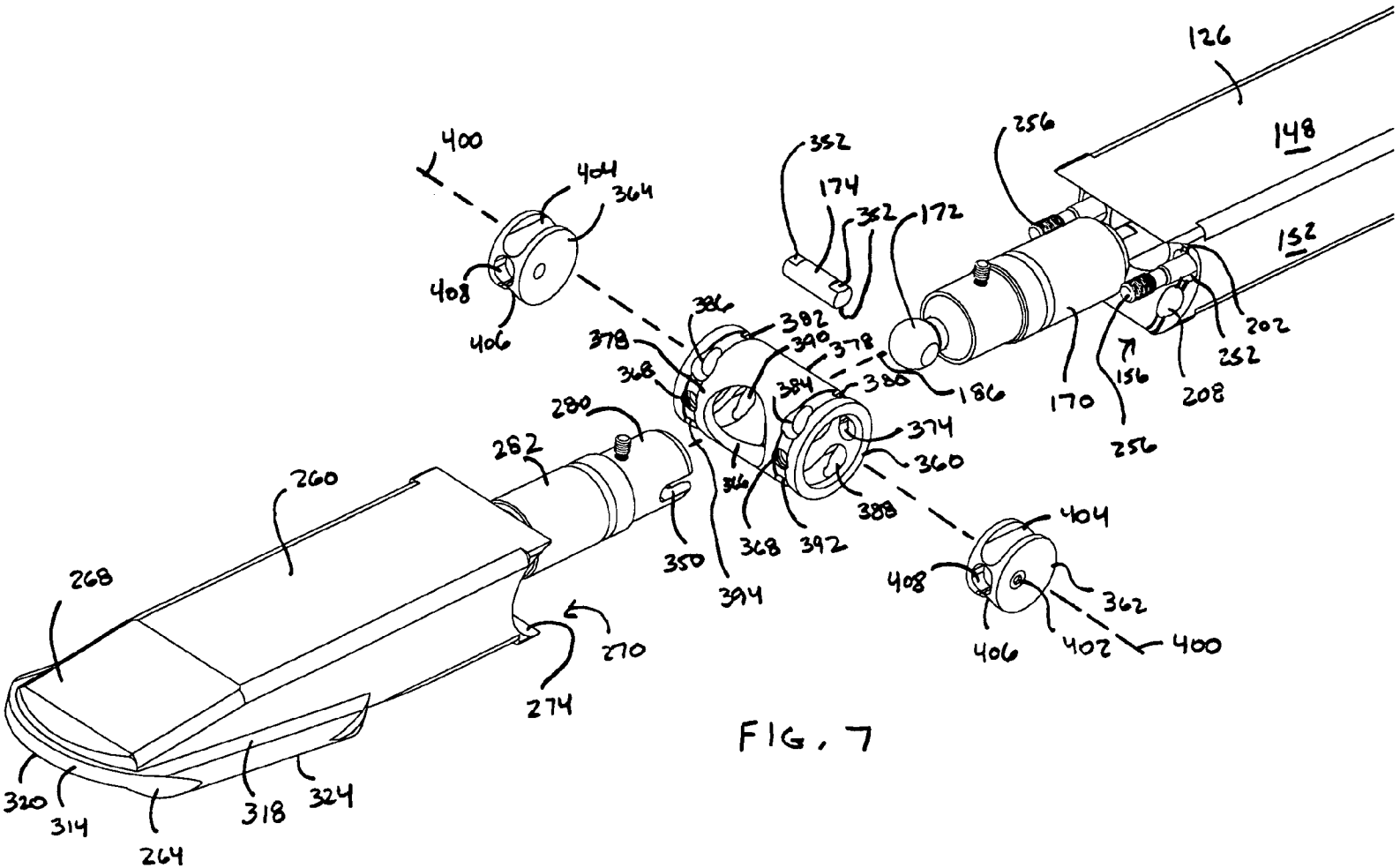
FIG. 7 is an exploded isometric close-up top-side view of the bit end of the power equine dental tool of FIG. 2 as viewed from the bit end of the power equine dental tool.
Figure 8:
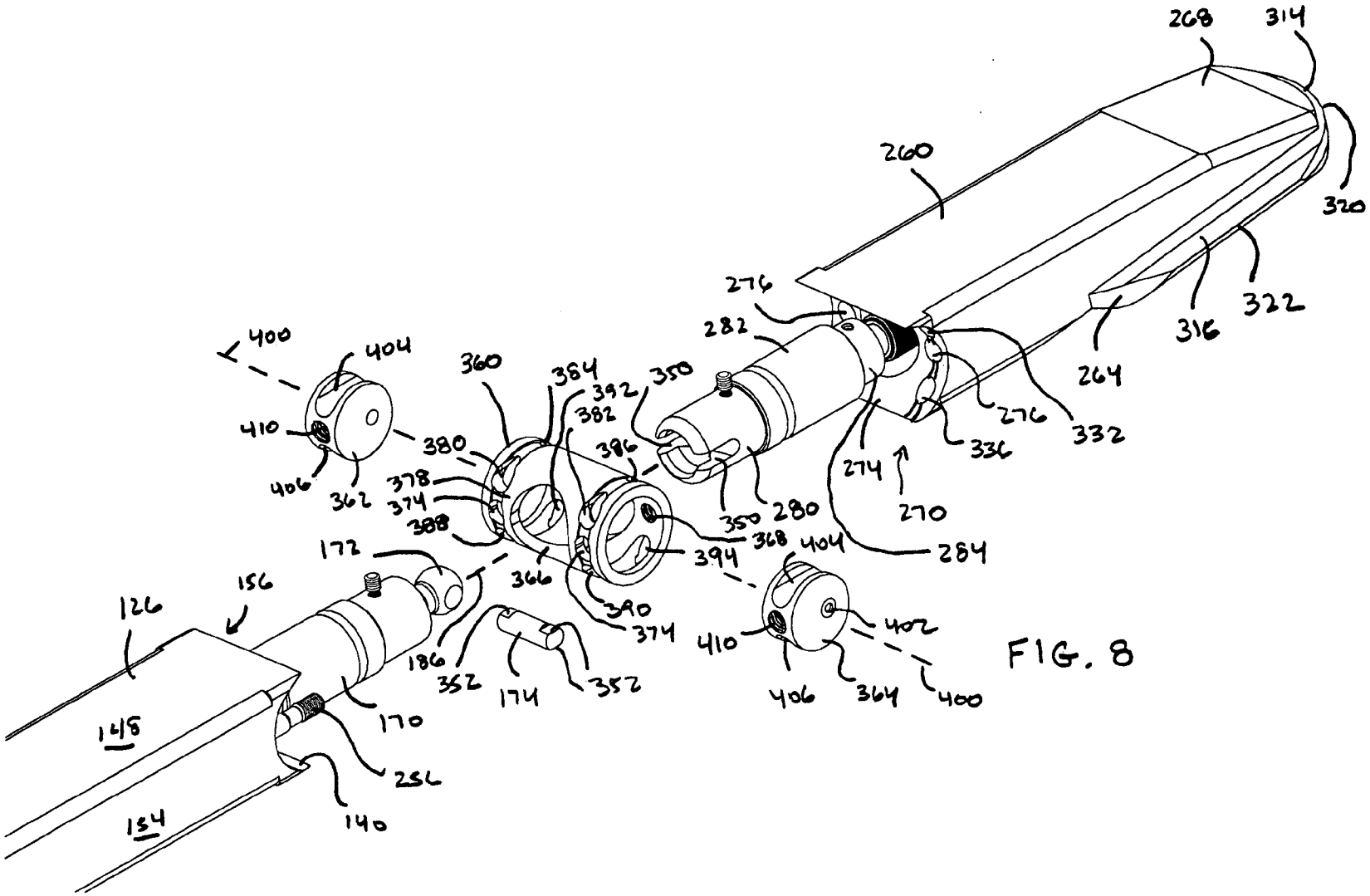
FIG. 8 is an exploded isometric close-up top-side view of the bit end of the power equine dental tool of FIG. 2 as viewed from the drive end of the power equine dental tool.
Figure 9:
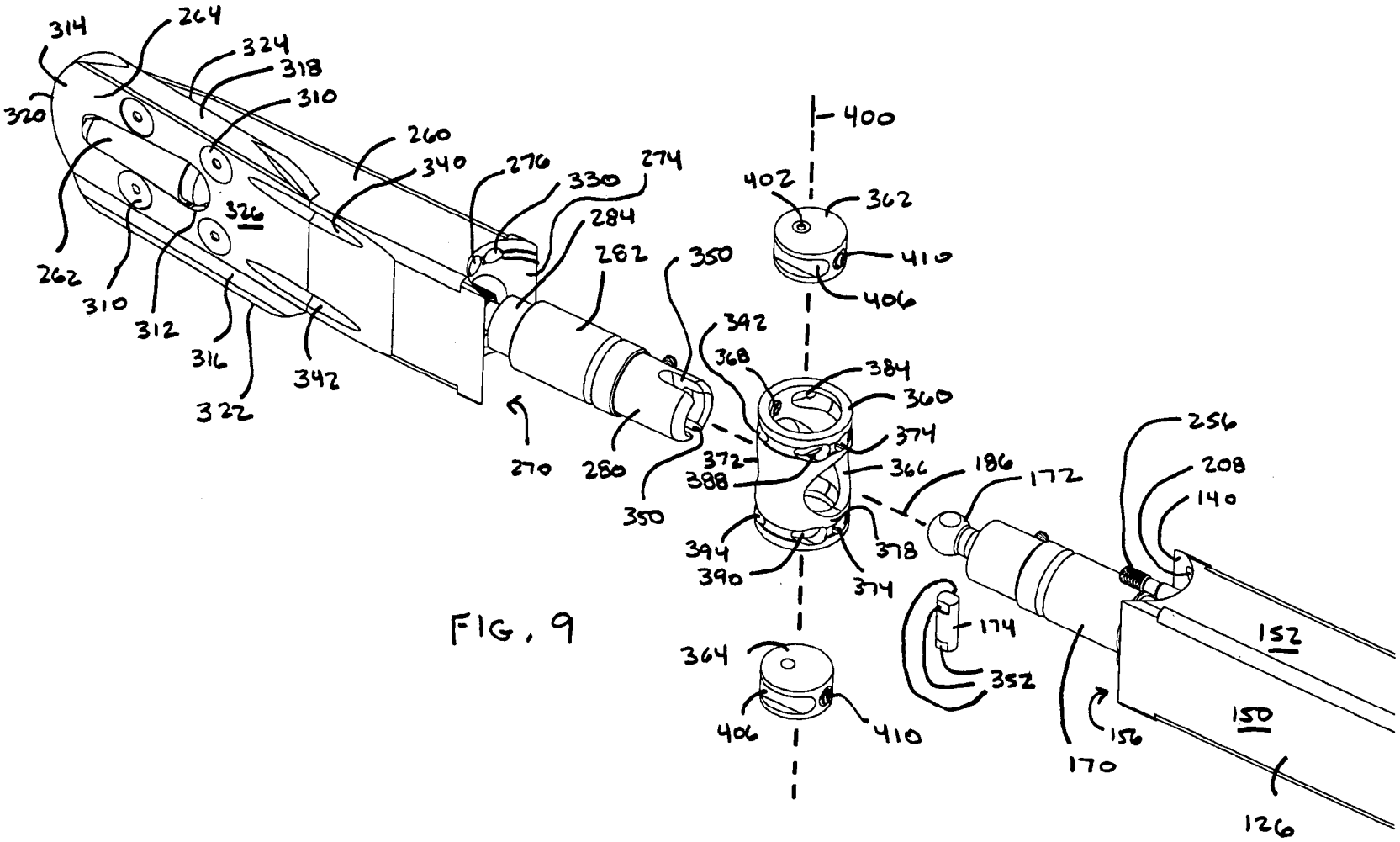
FIG. 9 is an exploded isometric close-up bottom-side view of the bit end of the power equine dental tool of FIG. 2 as viewed from the drive end of the power equine dental tool.

FIGS. 7, 8, and 9 show a detailed view of pivot joint 106. Pivot joint 106 includes a cylindrical pivot tube 360 and a pair of pivot tube nuts 362, 364. The concave pivot end surface 140 of tool body 126 also makes up a part of pivot joint 106. Pivot tube 360, when installed inside of dental tool 100, pivots about a pivot axis 400 that is perpendicular to longitudinal axis 186 of dental tool 100.

Pivot tube 360 includes a central drive joint opening 366 for receiving drive ball 172 and drive socket 280. A pair of threaded holes 368 are disposed on the front circumferential surface 372 (the surface nearest bit housing 260) of pivot tube 360, one on either side of central drive joint opening 366. Mounting screws 278 pass through holes 276 in bit housing 260 and are threaded into threaded holes 368 to fixedly attach pivot tube 360 to bit housing 260 and thereby also to bit housing assembly 104.

In addition to central drive joint opening 366 and threaded holes 368, pivot tube 360 also includes a pair of slotted draw rod openings 374 on its rear circumferential surface 378 (the surface nearest tool body 126). Slotted draw rod openings 374 are disposed one on either side of central drive joint opening 366 and are provided to allow each draw rod 256 to pass through pivot tube 360 and into a corresponding pivot tube nut 362 or 364 which are disposed inside of pivot tube 360.

A pair of slotted vacuum port openings 380, 382 are provided on rear circumferential surface 378. These slotted vacuum port openings are disposed on either side of, and slightly above, central drive joint opening 366. A corresponding second pair of slotted vacuum port openings 384, 386 are present on front circumferential surface 372 and are disposed in-line with slotted vacuum port openings 380, 382 respectively.

It should be noted that slotted vacuum port openings 380 and 384 are disposed on pivot tube 360 such that they are in-line with vacuum port 202 in tool body 126 and vacuum port 330 in bit housing 260. Similarly, slotted vacuum port openings 382 and 386 are disposed on pivot tube 360 such that they are in-line with vacuum port 204 in tool body 126 and vacuum port 332 in bit housing 260. Thus, each of the slotted vacuum port openings is disposed to allow vacuum suction to pass from tool body assembly 102 through pivot joint 106 and into bit housing 104.

Pivot tube 360 also includes a pair of slotted light source cable port openings 388, 390 on rear circumferential surface 378. These slotted port openings are disposed on either side of, and slightly below, central drive joint opening 366. A corresponding second pair of slotted light source cable port openings 392, 394 are present on front circumferential surface 372 and are disposed in-line with slotted port openings 388, 390 respectively.

It should be noted that slotted light source cable port openings 388 and 392 are disposed on pivot tube 360 such that they are in-line with light source cable port 208 in tool body 126 and light source cable port 334 in bit housing 260. Similarly, slotted light source cable port openings 390 and 394 are disposed on pivot tube 360 such that they are in-line with light source cable port 210 in tool body 126 and light source cable port 336 in bit housing 260. Thus, each of the slotted light source cable port openings is disposed to allow split light source cables 246 and 248 to pass from tool body assembly 102 through pivot joint 106 and into bit housing 104.

Each pivot tube nut 362, 364 is circular in shape and is inserted in an opening in the ends of pivot tube 360. A grease zerk 402 is provided on the outside surface of each pivot tube nut to allow for lubrication of pivot joint 106. A vacuum channel 404 is cut through the top circumferential edge surface of each nut. In a similar manner, a light source channel 406 is cut through the bottom circumferential edge surface of each nut. Channels 404, 406 are oriented perpendicular to pivot axis 400.

Each vacuum channel 404 is disposed to be in-line with a corresponding pair of slotted vacuum port openings in pivot tube 360 when pivot tube nuts 362, 364 are installed in pivot tube 360. Thus, it can be seen that a pair of vacuum passageways are provided on either side of pivot joint 106 to allow for vacuum suction to pass through pivot joint 106 from tool body assembly 102 and into bit housing assembly 104.

In a similar manner, each light source cable channel 406 is disposed to be in-line with a corresponding pair of slotted light source cable port openings in pivot tube 360 when pivot tube nuts 362, 364 are installed in pivot tube 360. Thus, a pair of light source cable passageways are also provided through pivot joint 106 to allow for the passage of internal light source cables 246, 248 through pivot joint 106 from tool body assembly 102 and into bit housing assembly 104.

In addition to channels 404 and 406, the front circumferential edge surface (surface closest to bit housing 260) of each pivot tube nut 362, 364 includes a oblong slot 408 drilled partially into the edge surface of the nut. Oblong slots 408 are provided for the following purpose. As previously discussed, mounting screws 278 are provided to attach pivot tube 360 to bit housing 260. The threaded end of each mounting screw 278 is threaded into holes 368 to make this attachment. To insure for complete thread engagement, however, it is desirable to have the threaded ends of each mounting screw 278 protrude through holes 368 and into the center of pivot tube 360. Oblong slots 408 are included to provide clearance between the threaded end of each mounting screw 278 and each pivot tube nut 362 or 364.

The rear circumferential edge surface (surface closest to tool body 126) of each pivot tube nut 362, 364 includes a drilled and tapped threaded hole 410. These holes, which are disposed on each pivot tube nut to be in-line with holes 252 in tool body 126, are provided for receiving the threaded pivot ends of draw rods 256. The threaded draw rod ends pass through slotted draw rod openings 374 in the rear circumferential surface of pivot tube 360 and into threaded holes 410 to slidably attach pivot tube 360 to tool body assembly 102.

Assembly of equine dental tool 100 will now be described. Initial assembly begins by partially assembling bit housing assembly 104. First bearing subassembly 282 is slid on to collet shaft 286. Drive socket 280 is then attached to the pivot end of collet shaft 286 and is secured in place using either a set screw or a spring pin that passes through collet shaft 286. In one embodiment, bearing subassembly 282 is held in place on collet shaft 286 by shoulder 356 and drive socket 280. In an alternative embodiment, a bearing retaining collar 284 is used to secure bearing assembly 282 in place next to drive socket 280.

At this point, bit drive shaft subassembly 266 is inserted into bit drive shaft opening 300 from rear curved pivot end surface 274 of bit housing 260 until the forward end of bearing subassembly 282 abuts up against shoulder 306. In this installed position, drive socket 290 extends out of the coped pivot end 270 of bit housing 260.

With bit drive shaft subassembly 266 installed into bit drive shaft opening 300, the next step is to attach pivot joint 106 to coped end 270 of bit housing 260. This is accomplished by sliding central drive opening 366 of pivot tube 360 over drive socket 280 such that front circumferential surface 372 (the surface closest to bit housing 260) of pivot tube 360 is disposed adjacent to curved pivot end surface 274 of bit housing 260. At this point, each threaded hole 368 on the front circumferential surface 372 of pivot tube 360 should be in alignment with a respective mounting screw hole 276 in bit housing 260. The two mounting screws 278 are then inserted into holes 276 of bit housing 260 and are partially threaded into threaded holes 368 on the front circumferential surface of pivot tube 360. It should be noted that each screw 278 is only partially threaded into its respective threaded hole 368 at this time such that the ends of the screws do not penetrate into the interior of pivot tube 360.

A pivot tube nut is now inserted into each open end of pivot tube 360 with the slotted clearance recess 408 on the edge of the pivot tube nut adjacent to threaded hole 368 on pivot tube 360. Each mounting screw 278 is now further threaded into holes 368 such that the threaded ends of each screw 278 protrudes completely through the front circumferential wall 372 of pivot tube 360 and into the slotted clearance openings 408 in the edge of each pivot nut. This insures that there will be complete thread engagement between the threads on screws 278 and the threads of threaded holes 368. In this manner, pivot joint 106 is fixedly attached to coped end 270 of bit housing 260 and drive socket 280 extends through central drive opening 366 and into the interior of pivot tube 360.

We now turn to drive shaft assembly 128. Drive ball 172 is first installed on to the pivot end of drive shaft 160. A set screw or spring pin is used to hold drive ball 172 in place. Next, bearing subassembly 170 and bearing retaining collar 168 are slid onto drive shaft 160 and positioned next to drive ball 172. Retaining collar 168 is positioned on drive shaft 160 to hold bearing subassembly 170 in place next to drive ball 172. A set screw is used to hold bearing retaining collar 168 at the desired location on drive shaft 160.

We now turn our attention to tool body assembly 102. We begin by inserting vacuum seal tube 224 into recess 222 on the front mating surface 132 of accessory mounting block 122. At this time, we can also thread vacuum hose adaptor 218 into threaded input hole 214 of accessory mounting block 122.

Next, we begin installing light source cable 242 into tool body assembly 102. This is accomplished by first placing accessory mounting block 122, handle mounting block 124 and tool body 126 in their respective aligned positions next to each other on a flat surface. These three components should be placed on the flat surface such that the top surface 148 of tool body 126 is facing downward and thus the two light source cable ports 208, 210 in tool body 126 are away from the flat surface.

The end of one of the split light source cables 246, 248 is first inserted through light source cable port 206 of accessory mounting block 122 from the accessory mounting side of accessory mounting block 122 such that it protrudes out of the other end by about an inch or so. The end of the other split light source cable is then inserted through light source cable port 206 of accessory mounting block 122 in a similar manner.

At this point, the ends of each split cable 246, 248 protrude out of the front side of accessory mounting block 122 by about an inch or so. Split cables 246, 248 are now pulled together through light source cable port 206 until adaptor 250 on the non-split end of light source cable 242 abuts up against shoulder 234 of light source cable port 206.

Adaptor retaining collar 120 can now be threaded into threaded input port 230 to hold adaptor 250 in place. It should be noted that it is desirable to hold non-split cable 244 which protrudes out of the front side of accessory mounting block 122 while threading retaining collar 120 into threaded hole 230. The reason for this is to insure that internal light source cable 242 is not twisted during installation of retaining collar 120.

At this point, the ends of each split light source cable 246, 248 are inserted completely through light source cable port 206 of handle mounting block 124 and into a respective one of the two light source cable ports 208, 210 in tool body 126. Talcum powder can be applied to the outer sheath of each split cable 246, 248 to provide for easier insertion of the cables through tool body 126. It should be noted that the inside wall surfaces of light source cable ports 208, 210 should be clean and dry before insertion of cables 246, 248 begins. If the inside surfaces of these ports are not clean and dry, the talcum powder may stick to the inside hole surfaces making insertion more difficult.

Eventually, the end of each split light source cable 246, 248 will emerge from coped pivot end 156 of tool body 126. At this point, accessory mounting block 122 is positioned adjacent to, but spaced apart from, handle mounting block 124, handle mounting block 124 is positioned adjacent to, but spaced apart from, tool body 126, and internal light source cable 242 has been inserted through each of these three components. The drive end of partially assembled drive shaft assembly 128 is now inserted into drive shaft opening 184 from coped pivot end 156 of tool body 126 and is pushed through the drive shaft opening in handle mounting block 124 and accessory mounting block 122, each of which should still be lying in alignment with tool body 126 on the flat surface.

Drive shaft assembly 128 is not pushed all the way into tool body 126 at this time however. Rather, it is inserted to the point where drive ball 172 extends out of coped pivot end 156 by about an inch or so. The reason for doing this is to provide access to drive ball 172 so that it can be mated with drive socket 280. It should also be noted that even in this position, the drive end of drive shaft 160 (with nothing assembled onto it) extends out of accessory mounting block 122 and is also accessible.

With internal light source cable 242 installed in partially assembled tool body assembly 102, and with partially assembled drive shaft assembly 128 inserted into drive shaft opening 184, the next step is to insert the two draw rods 256 into draw rod holes 252 from coped pivot end 156 of tool body 126. Each draw rod is inserted such that its slotted end (the end configured to receive the blade of a screwdriver) will be disposed at the drive end of tool body assembly 102 adjacent accessory mounting block 122.

Next, the pivot joint end of bit drive shaft assembly 266, which is now disposed inside of pivot tube 360, is mated with the pivot joint end of drive shaft subassembly 128. To accomplish this, the coped pivot end of partially assembled tool body assembly 102 is placed in close proximity to the pivot end of partially assembled bit housing assembly 104 such that the two assemblies are in longitudinal alignment with each other.

With these two assemblies in close proximity to each other, drive pin 174 is inserted into drive ball 172 and drive ball 172 is moved toward drive socket 280. This is accomplished by holding onto the drive end of drive shaft 160 and slowly pushing it into accessory mounting block 122. At the same time that it is being slowly pushed forward, drive shaft 160 is also rotated slightly. Rotation of drive shaft 160 results in rotation of drive pin 174 and in this way, drive pin 174 can be rotated into alignment with a pair of drive pin receiving slots 350 disposed on drive socket 280. Drive shaft 160 is rotated until the flat end surfaces 352 of drive pin 174 are received in drive pin receiving slots 350 of drive socket 280. At this point, drive ball 172 is pushed inside of drive socket 280 to complete the connection between drive shaft assembly 128 and bit drive shaft assembly 266.

With the drive joint assembled, the next step is to attach pivot joint 106 to coped pivot end 156 of tool body 126. This is accomplished by slowly sliding partially assembled tool body assembly 102 forward such that the mated drive ball joint slides into central drive opening 366 of pivot tube 360. As coped end 156 of tool body 126 approaches pivot tube 360, the ends of each split light source cable 246, 248, which are protruding from coped end 156, slide through slotted openings 388, 390 in rear circumferential surface 378 of pivot tube 360, through slotted channels 406 in pivot tube nuts 362, 364, through slotted openings 392, 394 in front circumferential surface 372 of pivot tube 360, and into their respective light source cable ports 334, 336 in bit housing 260. At this point, the ends of each split light source cable should be disposed in close proximity to their final position inside of bit housing assembly 104.

At this point, the threaded pivot end of each draw rod 256 should be disposed in or near one of the slotted draw rod openings 374 in rear circumferential face 378 of pivot tube 360 and in close proximity to a respective threaded hole 410 in pivot tube nuts 362, 364. At the same time, the other end of each threaded rod should be in close proximity to the threaded section of its respective draw rod hole located in accessory mounting block 122.

The front end of partially assembled dental tool 100 should now be placed up against a fixed surface to prevent it from sliding forward. The various components of dental tool 100 should then be pushed together such that the ends of each draw rod 256 are inserted into their respective threaded holes 410 in pivot tube nuts 362, 364 and threaded holes 254 in accessory mounting block 122.

A slotted screwdriver is inserted into a first one of the draw rod access holes 258 disposed on rear accessory mounting surface 130 of accessory mounting block 122. The first of the two draw rods is turned counterclockwise approximately one-half turn, just enough to engage the threads on each end of the draw rod with threaded holes 410 in pivot tube nuts 362, 364 and threaded holes 254 in accessory mounting block 122. The screwdriver is then moved to the other draw rod access hole and the other draw rod is turned counterclockwise approximately one-half turn to accomplish the same thing.

Each draw rod 256 is then alternately turned using the screwdriver inserted into the access holes that are provided on the rear face 130 of accessory mounting block 122. As each draw rod is turned a half turn, first one, then the other, the ends of each draw rod are slowly threaded into threaded holes 410 in pivot tube nuts 362, 364 and into threaded holes 254 on the flat front mating surface 132 of accessory mounting block 122. This in essence pulls or draws all of the parts together. The draw rods are alternately turned until the entire assembly is drawn together. At this point, accessory mounting block 122 should be tight up against handle mounting block 124, handle mounting block 124 should be tight up against tool body 126, and the rear circumferential surface 378 of pivot tube 360 should be in slidable engagement with curved pivot surface 140 of tool body 126. It should also be noted that as accessory mounting block 122 is drawn toward handle mounting block 124, vacuum seal tube 222 is drawn into round hole 226 on handle mounting block 124.

The next step is to assemble the drive end of drive shaft assembly 128. This is accomplished by first sliding bearing retaining collar 166 and the two ball bearings 164 onto the drive end of drive shaft 160. Drive cable adaptor 162 is then attached to the drive end of drive shaft 160 using a pair of set screws or a spring pin that passes through drive shaft 160. With drive cable adaptor 162 attached to drive shaft 160, bearing retaining collar 166 is positioned on drive shaft 160 to retain the two side-by-side ball bearings 164 next to drive cable adaptor 162. Bearing retaining collar 166 is secured in place on drive shaft 160 using a small set screw or spring pin.

At this point, bit 262 can now be installed in bit housing 260. First, a keyed wrench having a square shaft is inserted into square receptacle 354 in the end of drive cable adaptor 162 thereby preventing rotation of drive shaft 160 and collet shaft 286 (which is now connected to drive shaft 160). Next, collet nut 288 is slid onto bit shaft 290 and bit shaft 290 is inserted into the bit end of collet shaft 286. Collet nut 288 is then threaded onto collet shaft 286 until bit shaft 290 is locked in place on the end of collet shaft 286. At this point, bit guard 264 can be installed onto bit housing 260 using screws 310.

The final steps in assembling dental tool 100 involve installation of angle locking handle 110 and pistol grip handle 108. Angle locking handle 110 is threaded into drive shaft opening 184 from the rear end of accessory mounting block 122 until it abuts lightly up against the locking shoulder portion 192 of flat mating surface 134 of handle mounting block 124. Finally, pistol grip handle 108 is installed onto one of handle mounting flanges 142, 144 and locking knob 118 is rotated to lock pistol grip handle 108 in place.

At this point, accessory mounting block 122, handle mounting block 124 and tool body 126 are fixedly attached to each other. Bit housing assembly 104, however, is capable of pivoting relative to tool body assembly 102 about pivot axis 400. This is because bit housing 104 is not fixedly attached to tool body assembly 102. Rather, bit housing assembly 104 is allowed to pivot upwards and downwards relative to longitudinal axis 186 and thus relative to tool body assembly 102. This occurs because pivot tube nuts 362, 364, to which tool body assembly 102 is fixedly attached, freely rotates inside of pivot tube 360 to which bit housing assembly 104 is attached. Since bit housing 104 is fixedly attached to pivot tube 360 and tool body assembly 102 is fixedly attached to pivot tube nuts 362, 364, and since pivot tube nuts 362, 364 freely rotate inside of pivot tube 360, bit housing assembly 104 can pivot relative to tool body assembly 102.

Figure 16:
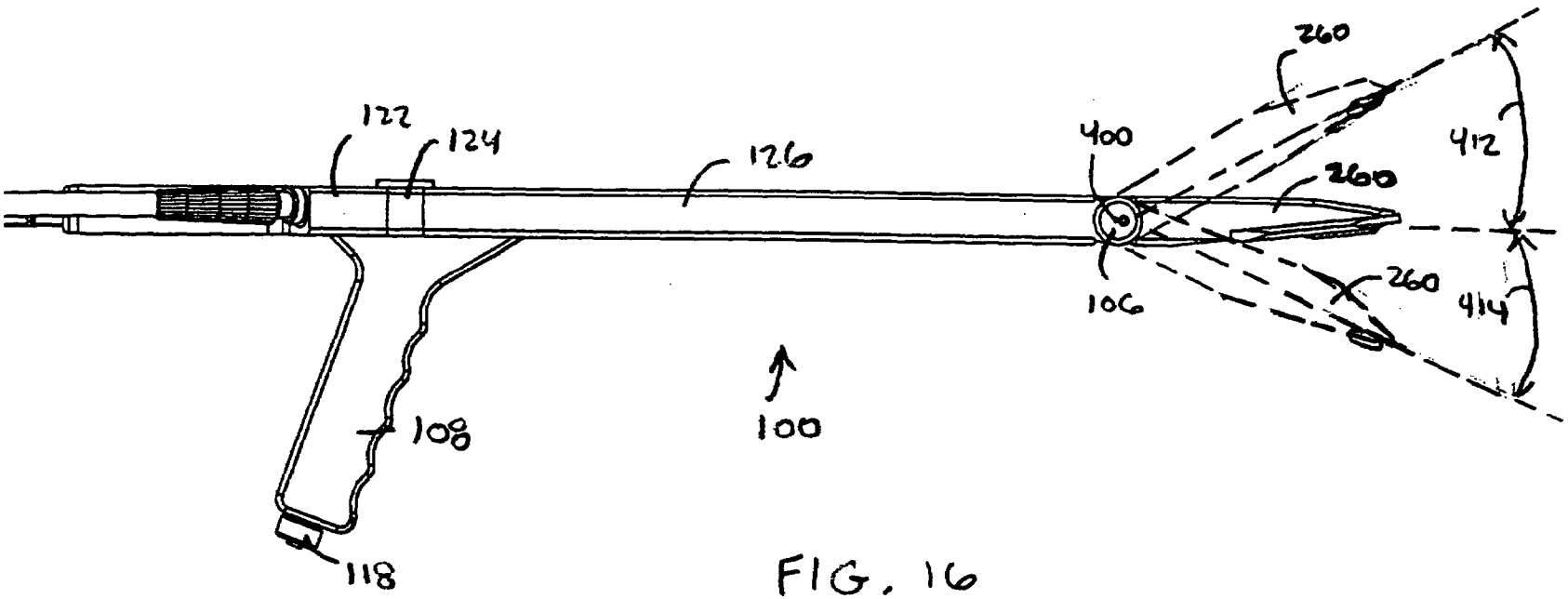
FIG. 16 is a side plan view of the dental tool of FIG. 1.

In one embodiment, the range of motion is 14 degrees, seven (7) degrees upward (see angle 412 in FIG. 16) and seven (7) degrees downward (see angle 414 in FIG. 16). In another embodiment, bit housing assembly 104 pivots as much as 2.5 degrees upwards (angle 412) and 11.5 degrees downward (angle 414). The limits on the range of motion is determined by the length of the various slotted openings that are provided in pivot tube 360 for receiving draw rods 256 and light source cables 246, 248. The longer the slots, the greater the range of motion. Of course, as pivot tube 360 is made larger in diameter, the length of these slots can be increased. However, increasing the size of pivot tube 360 also inevitably will increase the size and weight of the dental tool. Thus, a trade off must be maintained between range of bit motion and the size and weight of the dental tool.

To adjust the angle 412, 414 (see FIG. 16) of bit housing 104 relative to tool body 102 (and relative to longitudinal axis 186), bit housing 104 is simply pivoted about pivot axis 400. Once the desire angle is reached, angle locking handle 110 is threaded further into drive end section 185 of drive shaft opening 184 until the forward end of angle locking handle abuts tight up against locking shoulder 192 (which is part of rear mating surface 134 of handle mounting block 124).

Continuing to turn angle locking handle 110 at this point will cause accessory mounting block 122 to separate from handle mounting block 124 and will cause pivot joint 106 to be forced tight up against the coped end of tool body 126. This is because accessory mounting block 122 is attached to pivot joint 106 via draw rods 256. Thus as accessory mounting block 122 moves backward, so does pivot joint 106. More specifically, the rear circumferential surface 378 of pivot tube 360 is forced tight up against curved pivot end surface 140 of tool body 126 such that it is no longer in slidable engagement with curved pivot end surface 140. In this way, bit housing 104 can be locked at a desired angle relative to tool body 126. It should be noted that vacuum seal tube 224 is provided between accessory mounting block 122 and handle mounting block 124 to insure that the integrity of vacuum port 200 is maintained when angle locking handle 110 is used to lock bit housing 104 at a desired angle.

Figure 17:
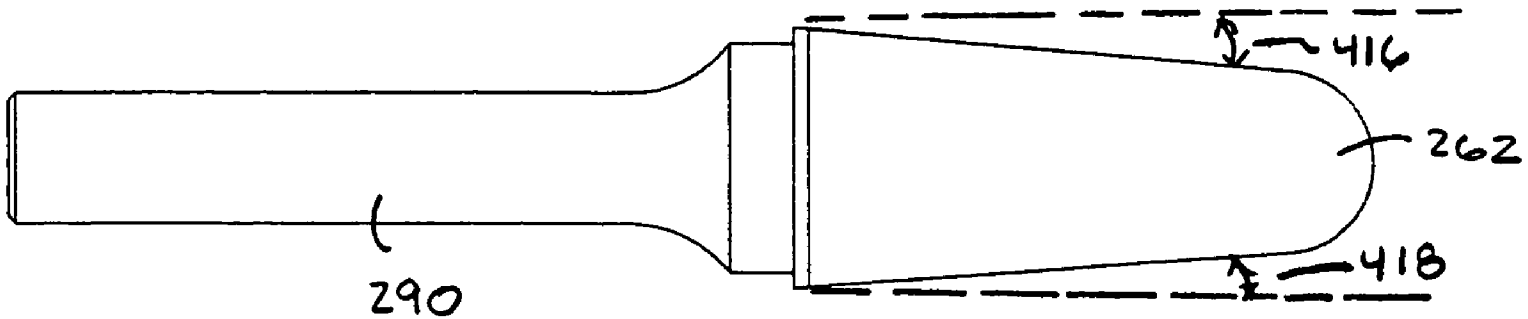
FIG. 17 is a plan view of a grinding member used in the dental tool of FIG. 1.

It should also be noted that grinding bit 262 in one embodiment is a tapered bit or bur having an included angle of fourteen (14) degrees. In other words, angle 416 in FIG. 17 is seven (7) degrees and angle 418 is seven (7) degrees. Using this bit in a dental tool having a range of bit housing angles of seven (7) degrees upward (angle 412) and seven (7) degrees downward (angle 414) will result in a net angle on the bit surface of fourteen (14) degrees upward and zero degrees downward.

If, on the other hand, a bit having an included angle of nine (9) degrees is used (e.g., angle 416 is 4.5 degrees and angle 418 is 4.5 degrees) in a dental tool having a range of bit housing angles of 2.5 degrees upward (angle 412) and 11.5 degrees downward (angle 414) will result in a net angle on the bit surface of seven (7) degrees upward and seven (7) degrees downward.

It should also be noted that the present invention is not limited to the use of a tapered bit grinding member or a grinding member having the angles described above. Other embodiments of the present invention use non-tapered bits or tapered bits having different included angles than those mentioned herein. The present invention is also not limited to the use of steel shanked carbide bits (or burs) and in other embodiments of the present invention, grinding members made of other materials are used instead.

Numerous modifications may be made to the present invention which still fall within the intended scope hereof. Thus, it should be apparent that there has been provided in accordance with the present invention an apparatus and apparatus for grinding the teeth of horses that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. An equine dental apparatus for floating the teeth of horses comprising:

a tool body, wherein the tool body includes a pivot joint having a pivot axis;

a drive shaft disposed along a first axis inside of the tool body, wherein the drive shaft includes a first end configured for attachment to a drive mechanism and a second end opposite the first end, and further wherein the drive shaft includes a first section disposed to rotate about the first axis, a second section disposed to rotate about a second axis, and a ball and socket joint disposed to couple the second section to the first section, wherein the ball and socket joint is disposed inside of the pivot joint; and a grinding member connected to the second end and partially housed in the tool body, wherein when the tool body is held in a fixed position with the drive shaft oriented horizontally, the grinding member is capable of pivoting upward through a first range of angles relative to the drive shaft and is further capable of pivoting downward through a second range of angles relative to the drive shaft, and further wherein the grinding member pivots through the range of angles about the pivot axis.

2. An equine dental apparatus for floating the teeth of horses comprising:

a tool body, wherein the tool body includes a pivot loint having a pivot axis;

a drive shaft disposed along a first axis inside of the tool body, wherein the drive shaft includes a first end configured for attachment to a drive mechanism and a second end opposite the first end;

a grinding member connected to the second end and partially housed in the tool body, wherein when the tool body is held in a fixed position with the drive shaft oriented horizontally, the grinding member is capable of pivoting upward through a first range of angles relative to the drive shaft, and is further capable of pivoting downward through a second range of angles relative to the drive shaft, and further wherein the grinding member pivots through the range of angles about the pivot axis; and a vacuum port disposed to suction enamel dust produced during the floating of teeth, wherein the vacuum port passes through the pivot joint.

3. The equine dental apparatus of claim 2 wherein the apparatus is configured for attachment to an external light source, and further wherein the apparatus is configured to provide light from the external light source, through at least a portion of the tool body, to the vicinity of the grinding member.

4. The equine dental apparatus of claim 3 further comprising the external light source.

5. An equine dental apparatus for floating the teeth of horses comprising:

a tool body, wherein the tool body includes a pivot loint having a pivot axis;

a drive shaft disposed alona a first axis inside of the tool body, wherein the drive shaft includes a first end configured for attachment to a drive mechanism and a second end opposite the first end;

a grinding member connected to the second end and partially housed in the tool body, wherein when the tool body is held in a fixed position with the drive shaft oriented horizontally, the grinding member is capable of pivoting upward through a first range of angles relative to the drive shaft and is further capable of pivoting downward through a second range of angles relative to the drive shaft, and further wherein the grinding member pivots through the range of angles about the pivot axis; and a source of illumination disposed to illuminate the teeth being floated, wherein the source of illumination passes through the pivot joint.

6. The equine dental apparatus of claim 5 wherein the source of illumination includes a cable, wherein the cable passes through the pivot joint.

7. The equine dental apparatus of claim 6 wherein the cable is a fiber optic cable.

8. The equine dental apparatus of claim 5 wherein the apparatus is configured for attachment to an external vacuum source, and further wherein the apparatus is configured to provide vacuum suction from the external vacuum source, through at least a portion of the tool body, to the vicinity of the grinding member to suction material produced during the floating of teeth.

9. The equine dental apparatus of claim 8 further comprising the external vacuum source.

10. An equine dental apparatus for floating the teeth of horses comprising:

a tool body;

a drive shaft disposed along a first axis inside of the tool body, wherein the drive shaft includes a first end configured for attachment to a drive mechanism and a second end opposite the first end;

a grinding member connected to the second end and partially housed in the tool body, wherein when the tool body is held in a fixed position with the drive shaft oriented horizontally, the grinding member is capable of pivoting upward through a first range of angles relative to the drive shaft and is further capable of pivoting downward throuah a second range of angles relative to the drive shaft; and a vacuum port disposed to suction enamel dust produced during the floating of teeth, wherein a portion of the vacuum port is disposed inside of the tool body.

11. The equine dental apparatus of claim 10 wherein the apparatus is configured for attachment to an external light source, and further wherein the apparatus is configured to provide light from the external light source, through at least a portion of the tool body, to the vicinity of the grinding member.

12. The equine dental apparatus of claim 11 further comprising the external light source.

13. An equine dental apparatus for floating the teeth of horses comprising:

a tool body;

a drive shaft disposed along a first axis inside of the tool body, wherein the drive shaft includes a first end configured for attachment to a drive mechanism and a second end opposite the first end;

a grinding member connected to the second end and partially housed in the tool body, wherein when the tool body is held in a fixed position with the drive shaft oriented horizontally, the grinding member is capable of pivoting upward through a first range of anales relative to the drive shaft and is further capable of pivoting downward through a second range of angles relative to the drive shaft; and a source of illumination disposed to illuminate the teeth being floated, wherein the source of illumination is at least partially disposed inside of the tool body.

14. The equine dental apparatus of claim 13 wherein the source of illumination includes a cable, wherein the cable is at least partially disposed inside of the tool body.

15. The equine dental apparatus of claim 14 wherein the cable is a fiber optic cable.

16. The equine dental apparatus of claim 13 wherein the apparatus is configured for attachment to an external vacuum source, and further wherein the apparatus is configured to provide vacuum suction from the external vacuum source, through at least a portion of the tool body, to the vicinity of the grinding member to suction enamel dust produced during the floating of teeth.

17. The equine dental apparatus of claim 16 further comprising the external vacuum source.

18. An equine dental apparatus for floating the teeth of horses comprising:

a first drive shaft disposed alona a first axis and configured for attachment to a drive mechanism;

a first housing member, wherein the first drive shaft is at least partially disposed inside of the first housing member;

a second drive shaft coupled to the first drive shaft, wherein the second drive shaft pivots relative to the first drive shaft about a second axis different from the first axis, wherein the second axis intersects the first axis;

a grinding member attached to the second drive shaft;

a second housing member, wherein the second drive shaft is at least partially disposed inside of the second housing member; and a pivot joint connecting the second housing member to the first housing member, wherein the pivot joint pivots about the second axis to allow the second housing member to pivot relative to the first housing member.

19. The equine dental apparatus of claim 18 wherein the apparatus further comprises a vacuum passageway disposed to suction enamel dust produced during the floating of teeth, wherein the vacuum passageway passes through the pivot joint.

20. The equine dental apparatus of claim 18 wherein the apparatus further comprises a source of illumination disposed to illuminate the teeth being floated, wherein the source of illumination passes through the pivot joint.

21. The equine dental apparatus of claim 20 wherein the source of illumination includes a cable, wherein the cable passes through the pivot joint.

22. The equine dental apparatus of claim 21 wherein the cable is a fiber optic cable.

23. The equine dental apparatus of claim 18 wherein the apparatus further comprises a vacuum passageway disposed to suction enamel dust produced during the floating of teeth, wherein a portion of the vacuum passageway is disposed inside of the first and second housing members.

24. The equine dental apparatus of claim 18 wherein the apparatus further comprises a source of illumination disposed to illuminate the teeth being floated, wherein the source of illumination is at least partially disposed inside of the first and second housing members.

25. The equine dental apparatus of claim 24 wherein the source of illumination includes a cable, wherein the cable is at least partially disposed inside of the first and second housing members.

26. The equine dental apparatus of claim 25 wherein the cable is a fiber optic cable.

27. The equine dental apparatus of claim 18 wherein the pivot joint further includes a ball and socket joint disposed between the first housing member and the second housing member.

28. The equine dental apparatus of claim 27 wherein the ball and socket joint couples the second drive shaft to the first drive shaft.

29. An equine dental apparatus for floating the teeth of horses comprising:

a first tool body member;

a second tool body member;

a drive shaft having a first section at least partially disposed inside of the first tool body member and a second section at least partially disposed inside of the second tool body member, wherein the second section is coupled to the first section, and further wherein the first section is disposed to rotate about a first axis;

a grinding member connected to the second section of the drive shaft and at least partially disposed inside of the second tool body member; and a pivot joint connecting the first tool body member to the second tool body member, wherein when the first tool body member is held in a fixed position such that the first axis is horizontal, the second tool body member is capable of pivoting upward through a first range of angles relative to the first tool body member and is further capable of pivoting downward through a second range of angles relative to the first tool body member.

30. The equine dental apparatus of claim 29 wherein the pivot joint further includes a ball and socket joint disposed between the first tool body member and the second tool body member.

31. The equine dental apparatus of claim 30 wherein the ball and socket joint couples the second section of the drive shaft to the first section of the drive shaft.

32. The equine dental apparatus of claim 29 wherein the apparatus further comprises a vacuum passageway disposed to suction enamel dust produced during the floating of teeth, wherein the vacuum passageway passes through the pivot joint.

33. The equine dental apparatus of claim 29 wherein the apparatus further comprises a source of illumination disposed to illuminate the teeth being floated, wherein the source of illumination passes through the pivot joint.

34. The equine dental apparatus of claim 33 wherein the source of illumination includes a cable, wherein the cable passes through the pivot joint.

35. The equine dental apparatus of claim 34 wherein the cable is a fiber optic cable.

36. The equine dental apparatus of claim 29 wherein the apparatus further comprises a vacuum passageway disposed to suction enamel dust produced during the floating of teeth, wherein a portion of the vacuum passageway is disposed inside of the first and second tool body members.

37. The equine dental apparatus of claim 29 wherein the apparatus further comprises a source of illumination disposed to illuminate the teeth being floated, wherein the source of illumination is at least partially disposed inside of the first and second tool body members.

38. The equine dental apparatus of claim 37 wherein the source of illumination includes a cable, wherein the cable is at least partially disposed inside of the first and second tool body members.

39. The equine dental apparatus of claim 38 wherein the cable is a fiber optic cable.

* * * * *